US009090054B2

(12) United States Patent
Hargreaves et al.

(10) Patent No.: US 9,090,054 B2
(45) Date of Patent: Jul. 28, 2015

(54) PRINTING METHOD AND PRINTING APPARATUS

(75) Inventors: Colin Hargreaves, Accrington (GB); David Hargreaves, Accrington (GB)

(73) Assignee: Emerson & Renwick LTD, Lancashire (GB)

( * ) Notice: Subject to any disclaimer, the term of this patent is extended or adjusted under 35 U.S.C. 154(b) by 767 days.

(21) Appl. No.: 13/059,949

(22) PCT Filed: Aug. 18, 2009

(86) PCT No.: PCT/GB2009/002015
§ 371 (c)(1),
(2), (4) Date: Jul. 18, 2011

(87) PCT Pub. No.: WO2010/020773
PCT Pub. Date: Feb. 25, 2010

(65) Prior Publication Data

US 2011/0283903 A1 Nov. 24, 2011

(30) Foreign Application Priority Data

Aug. 22, 2008 (GB) ..... 0815370.2
Jan. 12, 2009 (GB) ..... 0900431.8

(51) Int. Cl.
*B41F 15/00* (2006.01)
*B41L 13/00* (2006.01)
(Continued)

(52) U.S. Cl.
CPC ..... *B41F 15/0836* (2013.01)

(58) Field of Classification Search
CPC ... B41F 15/0836; B41L 13/06; B41P 2217/52
USPC ..... 101/116, 119, 124, 129, 114, 118, 120
See application file for complete search history.

(56) References Cited

U.S. PATENT DOCUMENTS 3,921,519 A 11/1975 Zimmer
3,926,111 A * 12/1975 Bohm ..... 101/116
(Continued)

FOREIGN PATENT DOCUMENTS

DE 3344131 6/1985
DE 201 16 246 3/2002
(Continued)

OTHER PUBLICATIONS

International Search Report dated Nov. 25, 2009 issued to international application No. PCT/GB2009/002015.
(Continued)

*Primary Examiner* — Blake A Tankersley
*Assistant Examiner* — Marissa Ferguson Samreth
(74) *Attorney, Agent, or Firm* — Knobbe, Martens, Olson & Bear, LLP

(57) ABSTRACT

Method of printing and printing apparatus whereby the repeat length is greater than the circumference of the rotary printing screen (5). This may be achieved by controlling the rotation of the screen as a non-printing zone (2) of the screen passes a moving web (w) such that an associated non-printed region formed on the screen has a length that is greater than the non-printing zone. This, in turn, may be achieved by suspending the rotation of the screen or reducing the speed of rotation when the non-printing zone is in registration with the web and then increasing the speed of rotation to a predetermined printing speed as a printing zone (1) of the screen comes into registration with the web.

22 Claims, 26 Drawing Sheets

(51) Int. Cl.

| | |
|---|---|
| ***B41M 1/12*** | (2006.01) |
| ***B41F 15/08*** | (2006.01) |

(56) References Cited

U.S. PATENT DOCUMENTS

| | | | | |
|---|---|---|---|---|
| 3,990,363 | A | 11/1976 | Vertegaal | |
| 5,213,033 | A * | 5/1993 | Bourgeois et al. | 101/116 |
| 6,123,022 | A * | 9/2000 | Takata | 101/119 |
| 6,948,426 | B2 | 9/2005 | Rush | |
| 2009/0064881 | A1 | 3/2009 | Belanger et al. | |
| 2011/0259221 | A1 | 10/2011 | Hargreaves et al. | |

FOREIGN PATENT DOCUMENTS

| | | |
|---|---|---|
| DE | 10145957 | 10/2002 |
| EP | 1604820 | 12/2005 |
| GB | 2 429 430 | 2/2007 |
| JP | 58-197084 | 11/1983 |
| JP | 2002-234139 | 8/2002 |

OTHER PUBLICATIONS

Written Opinion of the International Search Authority for International Application No. PCT PCT/GB2009/002015.

International Search Report and Written Opinion for PCT/GB2010/000041 mailed Apr. 27, 2010.

International Preliminary Report on Patentability and Written Opinion issued Jul. 21, 2011 to international application No. PCT/GB2010/000041.

* cited by examiner

PRINTING METHOD AND PRINTING APPARATUS

CROSS-REFERENCE TO RELATED APPLICATIONS

This application is the U.S. National Phase under 35U.S.C. §371of International Application No. PCT/GB2009/002015, filed Aug. 18, 2009, designating the United States and published in English on Feb. 25, 2010 as WO 2010/020773, which claims priority to United Kingdom Application No. 0815370.2, filed Aug. 22, 2008, and United Kingdom Application No. 0900431.8, filed Jan. 12, 2009.

FIELD OF INVENTION

The present invention relates to a method of printing and a printing apparatus.

BACKGROUND ART

Rotary screen printing systems typically comprise a rotatable cylindrical screen (sometimes referred to as a "printing cylinder") with an ink squeegee mounted therein. The screen is configured and continuously rotated with respect to a moving web so as to repeatedly print an image on a moving web. In conventional rotary screen printing systems, the rotational speed of the screen is synchronized with the web line-speed. Hence, the size of the image and image repeat length (i.e. the distance between common points of two adjacent repeat images) is determined by the useful printing circumference of the printing cylinder. The theoretical limit of the size of the image and image repeat length is the maximum viable circumference of the screen. However, the entire screen surface is not commonly used for printing. Usually, a section of the screen circumference is blank and non printing. This non-printing region is provided to delineate between individual printed images and to facilitate the joining of different pattern segments.

Accordingly, it is not possible for this type of conventional rotary screen printing system and method to print images with a size and repeat length that is larger than the circumference of the screen. For example, a rotary screen printing system having a screen with a circumference of 1m can not print images with a repeat length greater than 1m. Moreover, this rotary printing system and method can not print images with a "wall height" repeat (typically 2.4m or more).

Large repeats (images have a large size and repeat length) can be obtained using so-called flat printing by means of flat stencils. The product manufactured in this manner might comprise, for example, a bed sheet with a design printed on its head end. The mechanical process of manufacture is laborious and the rate of production thereof is limited.

U.S. Pat. No. 3,990,363 describes one particular solution to the problem of restricted repeat lengths. In this case, the squeegee pressure is released after an image has been printed onto a substrate and is only reapplied when the next repeat image is required. The screen maintains its rotational printing speed when the squeegee is disengaged. Due to the release of squeegee pressure, the pressure with which the screen stencil is in contact with the web is considerably decreased, or even reduced to zero. The problem with this arrangement is that it is difficult to prevent ink seepage through the rotating screen when the squeegee is disengaged from the screen. This results in ink transfer to the substrate between repeats with unsatisfactory contamination of non-print areas on the substrate or soiling of areas printed by a previous print station.

The problem of restricted image size has been solved by reducing the rotational speed of the screen with respect to the web line-speed so as to print a stretched or elongated image on the web. This type of printing process is commonly referred to as "slip" printing. Although the image is larger than the printing region of the screen, the image produced by slip printing is considered to be of an inferior quality.

Designers are presenting ever more challenging designs for printing. For example, designs having a large size format, remotely spaced images, random images and/or multiple colours. In many instances it has not been possible to reproduce these designs using a conventional rotary screen printing system due to the image size limitations, repeat length restrictions, ink seepage problems and the number of print stations required. Hence, to date, these challenging print designs are often only produced using digital printing technologies as opposed to rotary printing screen technology. However, digital printing technologies have their own limitations and can for example, only be used on certain substrates and by using a limited range of inks and ink technologies.

One particularly challenging design for printing, for example on wallpaper, is a large almost continuous design presented over the whole wall length with multiple repeated images at relatively large repeat separations. Using a conventional rotary screen printing process to try and achieve this design would require large numbers of print stations to build up the design in stages. In practice this arrangement would be unsuitable because it would be inherently difficult to control for quality, it would expensive and relatively inflexible.

There is therefore a need for new printing methods and devices to address or overcome one or more of the problems discussed above.

SUMMARY OF THE INVENTION

A first aspect of the invention relates to a method of printing an image on a web by means of a rotary printing screen wherein the repeat length is greater than the circumference of the rotary printing screen.

The production of a continuous web or of rectangular pieces of web printed with an image having a repeat length which is greater than the circumference of each rotary printing screen will be possible according to the invention provided the following features are applied:

(a) using a cylindrical screen, provided with an internal ink supply and an internal squeegee and having a screen surface with at least one permeable stencil area and at least one impermeable area, wherein the at least one stencil area and at least one impermeable area are parallel to the longitudinal axis of the stencil, (b) rotating the screen at a predetermined printing speed when a permeable stencil area is in registration with the web to be printed;

(c) suspending rotation of the screen or reducing the rotational speed of the screen from the printing speed when an impermeable area is in registration with the web; and (d) increasing the rotation of the screen to the predetermined printing speed as a permeable area comes into registration with the web.

In this arrangement, a printed region is formed on the web when a permeable stencil area passes over the web and a non-printed region is formed on the web when an impermeable area passes over the web.

By suspending the rotation of the screen or reducing the rotational speed of the screen when the impermeable area is in registration with the moving web, the length of the non-printed region will be greater than the circumferential length of the associated impermeable area. Thus, the overall repeat length is greater than the circumference of the screen.

By controlling the rotation of the screen when the impermeable area is in registration with the web (e.g. by controlling the time intervals between suspending and recommencing rotation of the screen and/or by controlling the variation of rotational speed when the impermeable area is in registration with the web) it may be possible to produce a variety of different types of repeat lengths. For example, it may be possible to control the rotation of the screen when the impermeable area is in registration with the web so as to have:

(i) at least substantially identical time length intervals between the printed regions and thereby produce at least substantially identical repeat lengths;

(ii) random time intervals between the printed regions and thereby produce random repeat lengths;

(iii) variable time intervals between the printed regions and thereby produce variable repeat lengths.

If the rotational speed of the screen is reduced from the printing speed when an impermeable area is in registration with the web, it is preferable to significantly reduce the rotational speed (e.g. to a creeping speed).

Preferably, the rotation of the screen is recommenced or the rotational speed of the cylindrical screen is increased after the web has moved a predetermined distance and/or a predetermined time period has lapsed.

In one embodiment of the invention, the rotation of the screen may be reversed when a permeable area is in registration with the web. The reversal of motion may optimise the acceleration of the screen back up to the predetermined printing speed as the permeable area comes into registration with the web.

In one embodiment, it is possible to lift the squeegee away from the screen surface when the impermeable area passes over the web and then reapply the squeegee to the screen surface as the permeable area comes into registration with the web. Having a raised squeegee when the screen rotation has been suspended or reduced helps to avoid ink contamination of the web between printed regions.

In one embodiment, it is possible to lift the screen away from the web when the impermeable area passes over the web and then re-position the screen in mating contact with the web as the permeable area comes into registration with the web. By raising the screen when the screen rotation has been suspended or reduced helps to avoid ink contamination of the web between printed regions. It is also possible to utilize an arrangement by which the screen is also moved to a raised position when the squeegee pressure is reduced. This could be achieved by using the same mechanism that raises and reapplies the squeegee.

In one embodiment, it is possible to accurately align a printing zone of the screen with respect to a desired printing region on the web. Preferably, this may be achieved using a key mark registration system to print and scan a mark on the web with respect to every desired printed region. By printing a mark for every desired printed region a design comprising a plurality of different images (e.g. sequential images and/or overlaid images) may be accurately printed.

In one embodiment, it is possible to at least substantially contain ink within a restricted region on the screen surface. This may be achieved using a containment chamber. Preferably, the containment chamber is defined by the squeegee, screen surface and containment wall.

A second aspect of the invention relates to a method of printing a design on a web by means of a plurality of cylindrical screens, wherein at least part of the design has a repeat length that is greater than the circumference of the cylindrical screen concerned.

The production of a design on a web by means of a plurality of cylindrical screens, wherein at least part of the design has a repeat length that is greater than the circumference of the cylindrical screen associated with the printing that part of the design will be possible provided the following features are applied:

(a) using at least one cylindrical screen, provided with an internal ink supply and an internal squeegee and having a screen surface with at least one permeable stencil area and at least one impermeable area, wherein the at least one stencil area and at least one impermeable area are parallel to the longitudinal axis of the stencil, (b) rotating the screen at a predetermined printing speed when a permeable areas is in registration with the web to be printed;

(c) suspending rotation of the screen or reducing the rotational speed of the screen from the printing speed when an impermeable area is in registration with the material to be printed; and (d) increasing the rotation of the screen to the predetermined printing speed as a permeable area comes into registration with the web.

A third aspect of the invention relates to an apparatus for performing the method as indicated in the first aspect of the invention, the apparatus comprising a thin-walled cylindrical screen and also an ink supply means and squeegee arranged therein. The cylindrical screen comprises at least one stencil zone and at least one no-printing zone. The cylindrical screen is rotatably arranged over a common printing track, and means are provided for supporting and guiding the material to be printed along the printing track, while the apparatus has means for rotating the cylindrical speed at a printing speed when a stencil zone is registration with the material to be printed on, suspending rotation or significantly reducing the rotational speed of the screen when at least one of the non-printing zones is in registration with the material to be printed on and then increasing the speed of the screen to printing speed as a stencil zone comes into registration with the web.

The fourth aspect of the invention provides for a printing system for printing a design by means of one or more screen stencils, wherein at least apart of the design has a repeat length greater than the printing circumference of the stencil concerned, wherein the apparatus comprises means for transferring one or more printable substrates to one or more print stations, each print station comprising (a) a cylindrical screen stencil comprising a printing region and a non-printing region and associated ink supply and squeegee, (b) means for suspending and restarting or reducing and increasing rotational speed of the cylindrical screen stencil (c) means for ensuring that the non-printing region of the cylindrical screen stencil remains between the squeegee and the printable substrate for a predetermined period of time such that the print repeat is greater than the printing circumference of the cylinder.

DESCRIPTION OF THE DRAWINGS

For a better understanding of the invention, and to show how the same may be carried into effect, reference will now be made, by way of example, to various specific embodiments of the different aspects of the invention as shown in the accompanying diagrammatic drawings, in which:

FIGS. 5*a* and 5*b;*

DETAILED DESCRIPTION OF THE INVENTION

FIGS. 1 to 4 depict an embodiment of a rotary printing station according to the invention. The rotary printing station is suitable for printing at least one image on a web. One or more of the rotary printing stations may be used as part of a printing system comprising a plurality of rotary printing stations.

For the purposes of this document, the term "web" is to be understood as any material or substrate that is suitable for feeding through a rotary printing station and on which an image may be printed. The web may be a continuous web or individual pieces of web. The web may be, for example, a continuous sample of wallpaper and individual piece of wallpaper.

For the purposes of this document, the term "ink" is to be understood as any material that is suitable for forming an image on a web. The ink may comprise an ink material, dye and/or paint etc.

For the purposes of this document, the term "image" is to be understood as any type of image that may be printed on a web. The image may have a predetermined shape and/or colour. It is to be understood that a design may comprise a plurality of images and the plurality of images may comprise multiple different shapes and/or multiple different colours.

The rotary printing station as depicted in FIGS. 1-4 comprises a rotatable cylindrical screen (S) to print at least one image on a web (W), ink delivery means to supply ink to an inner surface (S4) of the screen, squeegee (SQ) to transfer the ink through a permeable stencil region of the screen and onto the web, drive system to rotatably drive the screen and web line means to feed the web through the rotary printing station.

The cylindrical screen (S) is a thin-walled cylinder having a first end portion (S1) and a second end portion (S2). The cylindrical screen may have any circumference size that is suitable for printing an image on a web. For example, the cylindrical screen may have a circumference of 537mm, 640mm, 725mm, 914mm, 1018mm and 1280mm. Typically, the size of the screen that is selected is dependent on the printing purpose, and also on the size of image and/or image repeat length required.

The cylindrical screen (S) comprises at least one printing zone and at least one non-printing zone. The at least one printing zone and at least one non-printing zone extend at least substantially around the circumference of the screen. So as to maximise the printing effect, the at least one printing region and/or at least one non-printing region preferably extend at least substantially across the width of the screen in a direction parallel to the longitudinal axis of the screen.

As an example, a cylindrical screen comprising a circumference of 640mm may have a printing zone having a circumferential length of 540mm and a non-printing zone of 100mm.

Figure 1:
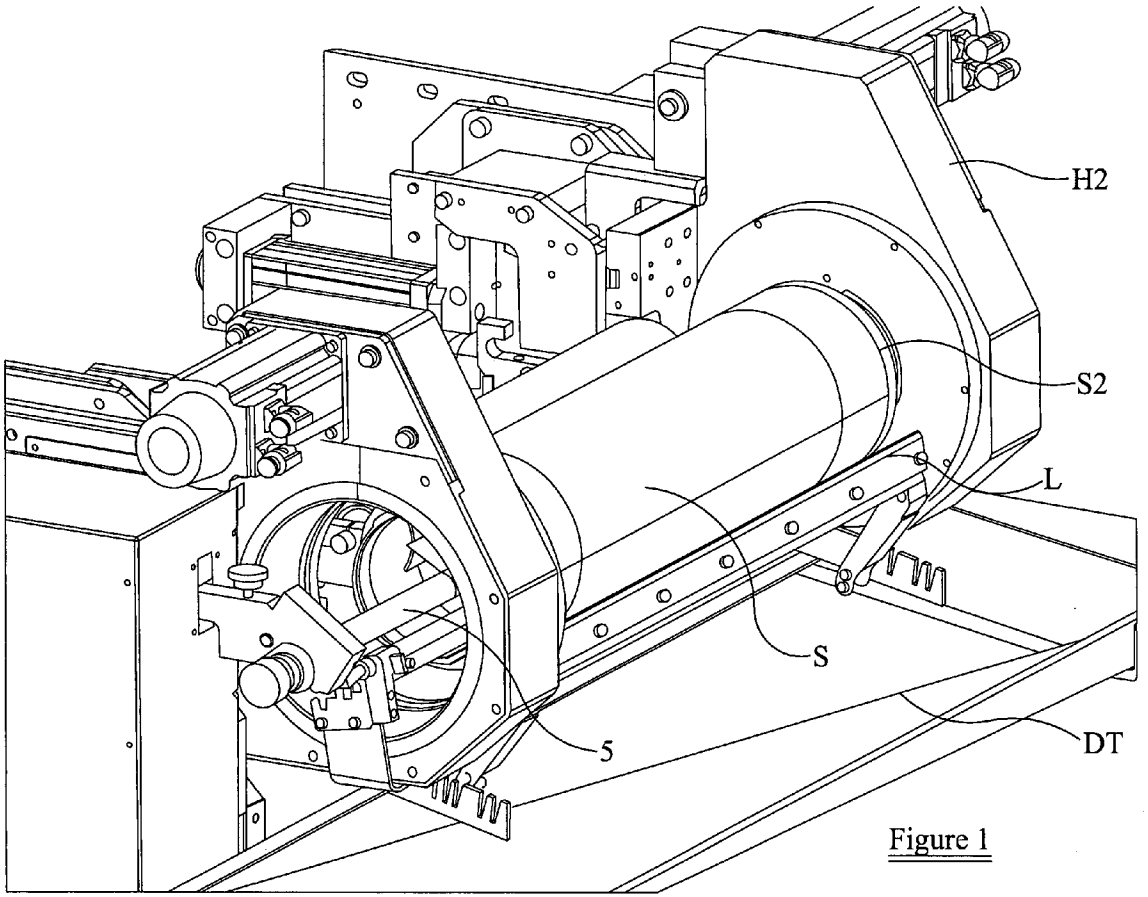
FIG. 1 is a perspective view of a rotary printing station according to an embodiment of the invention.
Figure 2:
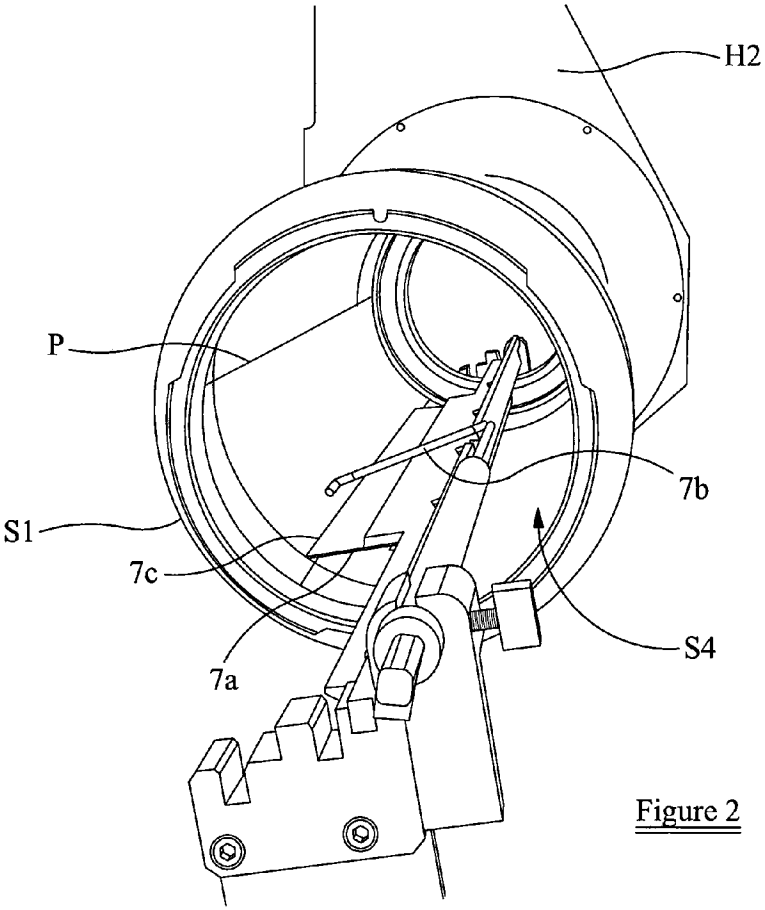
FIG. 2 is a cross-sectional view through a rotatable cylindrical screen of the printing station as depicted in FIG. 1.
Figure 3:
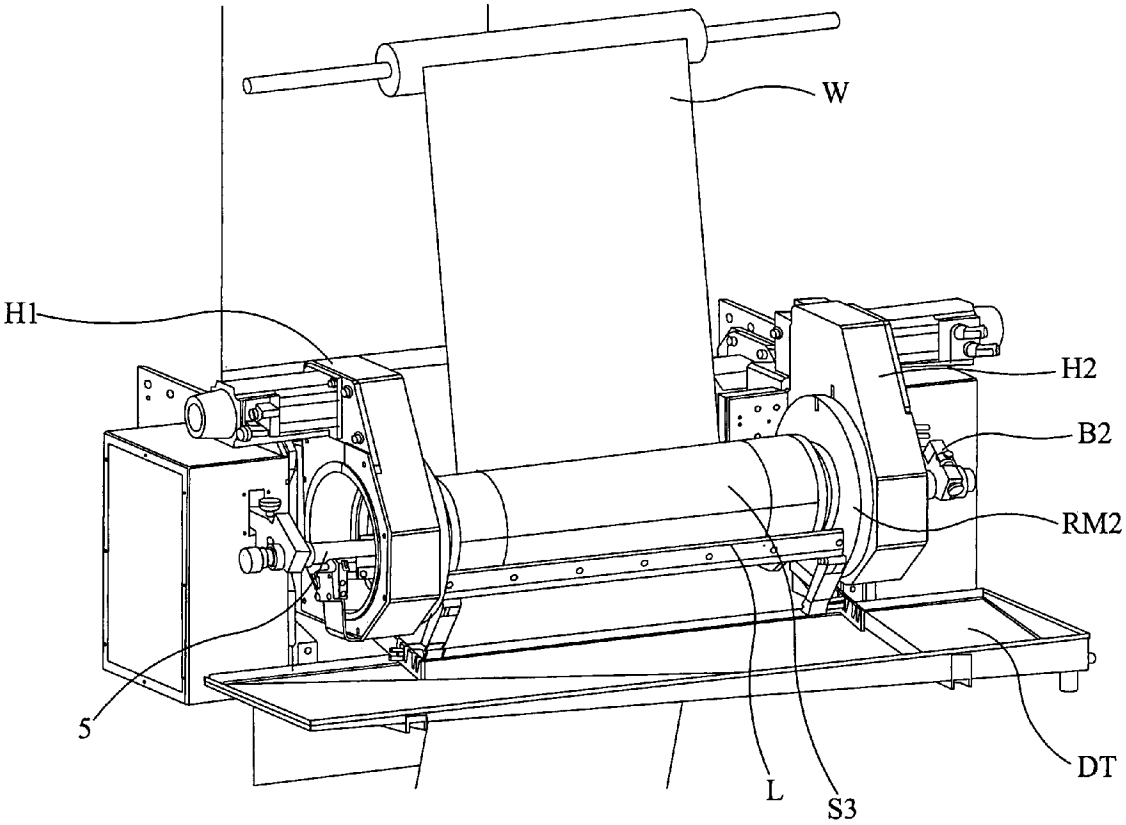
FIG. 3 is a perspective view showing a web being fed through the printing station as depicted in FIG. 1.
Figure 4:
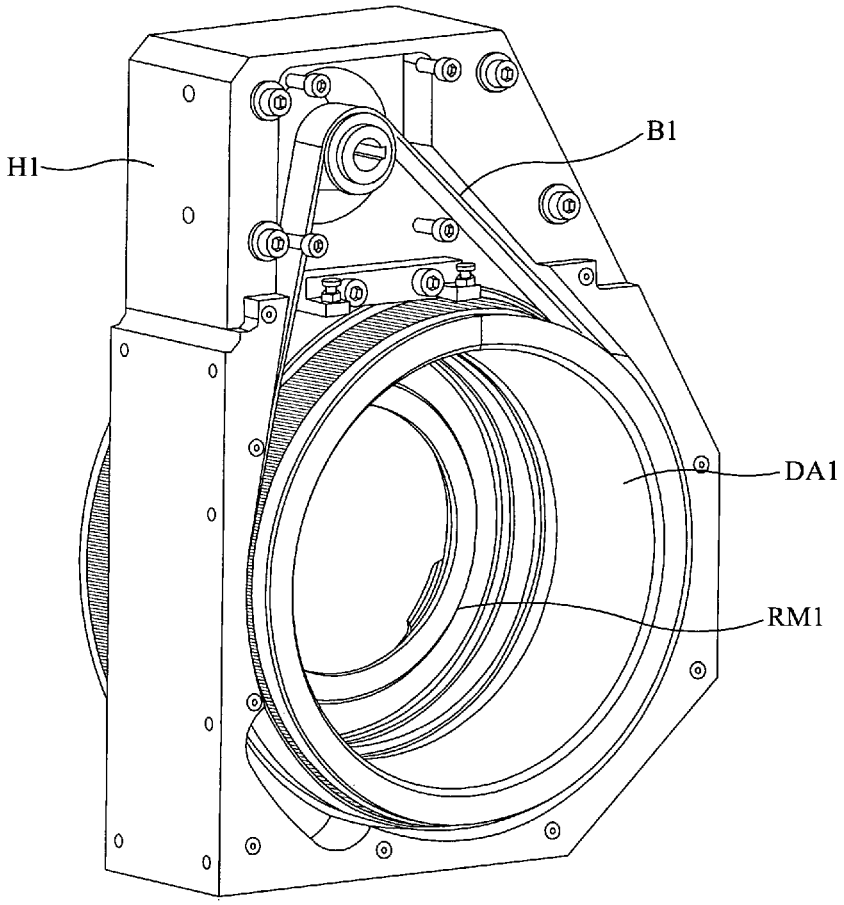
FIG. 4 is a cross-sectional view of a drive head of the printing station as depicted in FIG. 1.
Figure 5A:
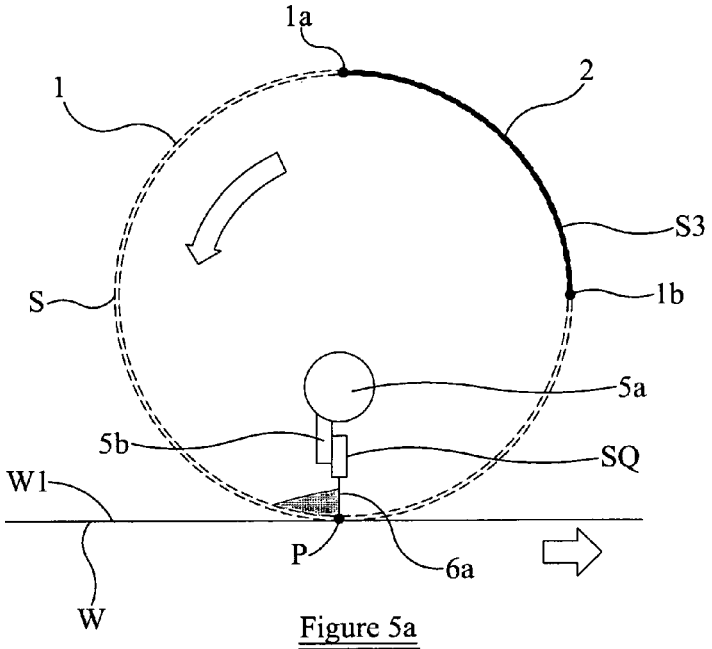
FIGS. 5*a* and 5*b* are cross-sectional schematic views showing of a first embodiment of a rotatable cylindrical screen according to the invention as it rotates in an anti-clockwise direction.
Figure 5B:
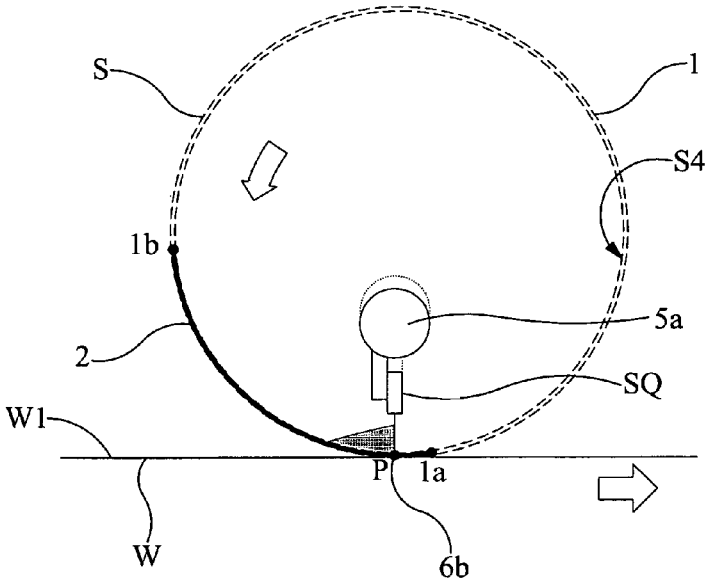

FIGS. 5*a* and 5*b* depict an embodiment of a screen that comprises a single printing zone (1) and a single non-printing zone (2) arranged around the circumference of the screen. In this case, the printing zone (1) extends between a first printing point (1*a*) and a second printing point (1*b*) on the circumference of the cylindrical screen. Both the printing zone (1) and the non-printing zone (2) extend across the width of the cylindrical screen. In this particular embodiment, the non-printing zone (2) covers a circumferential arc region of about 90 degrees whilst the printing zone (1) covers a circumferential arc region of about 270 degrees.

Figure 6B:
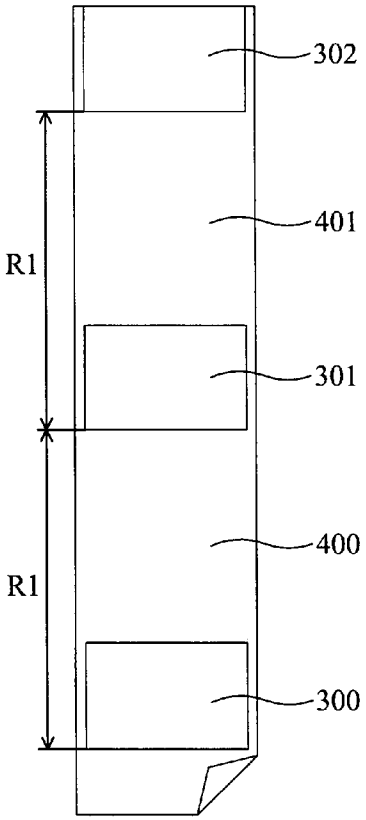
FIG. 6*b* is a view of an extract of a web that has been printed using the screen as depicted in FIG. 6*a;*
Figure 6A:
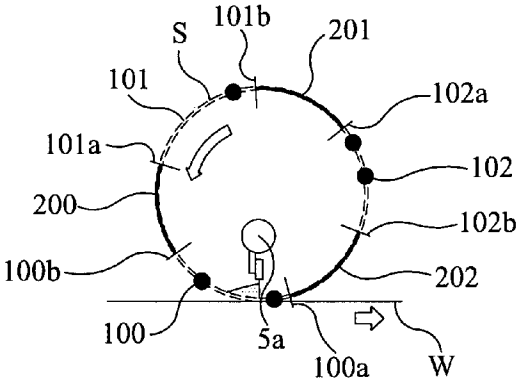
FIG. 6*a* is cross-sectional schematic views showing a second embodiment of a rotatable cylindrical screen according to the invention as it rotates in an anti-clockwise direction.

FIG. 6*a* depicts an embodiment of a cylindrical screen that comprises three printing zones (100, 101, 102) and three non-printing zones (200, 201, 202) arranged sequentially around the circumference of the cylindrical screen. In this case the first printing zone (100) extends between a first printing point (100*a*) and a second printing point (100*b*), the second printing zone (101) extends between a third printing point (101*a*) and a fourth printing point (101*b*) and the third printing zone (102) extends between a fifth printing point (102*a*) and a sixth printing point (102*b*). All the printing zones and non-printing zones extend across the width of the screen. In this particular embodiment all the zones have the same circumferential length and cover a circumferential arc region of about 60 degrees. However in a different embodiment, the circumferential lengths of the printing zones and/or non-printing zones may vary with respect to one another in accordance with the requirements of the final design and control system.

The at least one printing zone comprises a permeable stencil of an image to be printed. The circumferential length of the printing zone is dependent on the size of the image to be printed. In the example where the screen comprises a circumference of 640mm and the printing zone is 540mm, the stencil may be configured to produce an image that is 400mm long.

The at least one non-printing zone is at least substantially impermeable to ink. The circumferential length of the non-printing zone is also dependent on the size of the image to be printed and also on the dynamic requirements of screen, web line means and various control/adjustment means.

Due to the printing and non-printing zones of the screen, a revolution (operating cycle) of the screen forms corresponding printed and non-printed regions on the web. It is common in the printing industry to collectively refer to the printed regions and non-printed regions formed during a single revolution (a single operating cycle) of the cylindrical screen as a "repeat" or "image repeat". As the screen continues to rotate, multiple image repeats are formed on the web. The distance between a common point of two adjacent image repeats is commonly referred to as a "repeat length" or "image repeat length"

A printed region is formed on the web as the screen rotates and a printing zone passes over the web. A printed region on the web comprises a printed image that corresponds to the stencil of the associated printing zone. The screen is deemed to be in a "printing mode" as a printing zone passes over the web.

A non-printed region is formed on the web as the screen rotates and a non-printing zone passes over the web. A non-printed region on the web is at least substantially free from ink contamination. The screen is deemed to be in a "non-printing mode" as a non-printing zone passes over the web.

To reiterate, since a screen comprises at least one printing zone and at least one non-printing zone, a screen may undergo at least one printing mode and at least one non-printing mode during an operating cycle (a single complete revolution of the screen). A screen comprising only one printing zone will print only one image (printed region) per operating cycle. A screen comprising 2, 3, . . . X printing zones will print 2, 3, . . . X images (printed regions) respectively per operating cycle. For the sake of clarity, we shall refer to a repeat made up of multiple printed regions and non-printed regions as comprising multiple "repeat portions" (a printed region and its associated non-printed region) that are separated by a "repeat portion length". For example, when in operation, the screen depicted in FIG. 6*a* will produce a repeat comprising three repeat portions (see FIG. 6*c*).

Figure 5C:
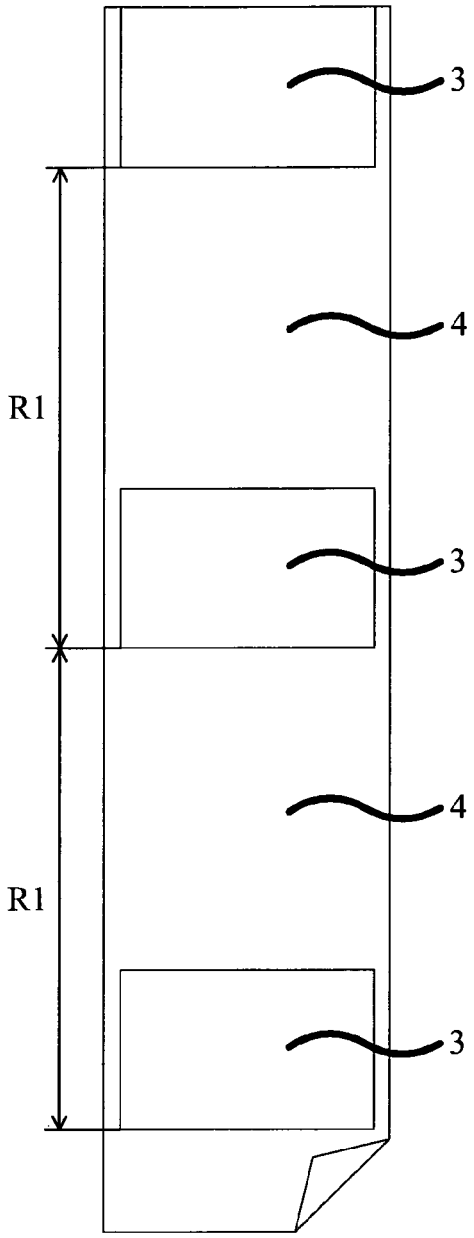
FIG. 5*c* is a view of an extract of a web that has been printed using the screen as depicted in FIGS. 5*a* and 5*b;*

FIG. 5*c* depicts an extract of an example of a web that has been printed using the screen depicted in FIGS. 5*a* and 5*c*. The web extract comprises two image repeats having an image repeat length R1. Each repeat comprises a printed region (3) (formed as the printing zone (1) passed over the web) and a non-printed region (4) (formed as the non-printing zone (2) passed over the web).

FIG. 6*b* depicts an extract of an example of a web that has been printed using the screen as depicted in FIG. 6*a*. Since the screen comprises three printing zones sequentially interspaced by three non-printing zones of the screen, the repeat comprises three repeat portions. The distance between each repeat portion is identical, R1. The first printed region (300) was formed as printing zone (100) passed over the web. The first non-printed region (400) was formed as non-printing zone (200) passed over the web. The second printed region (301) was formed as printing zone 101 passed over the web. The second non-printed region (401) was formed as non-printing zone (201) passed over the web. The third printed region (302) was formed as printing zone (102) passed over the web. The third non-printed region (not shown) was formed as non-printing zone (202) passed over the web.

In operation, the web may be fed to pass over the screen in any suitable direction or at any suitable angle. For example, in the embodiments depicted in FIGS. 5*a*, 5*b* and 6*a* the web is fed in a substantially horizontal direction relative to the screen. The web may alternatively be fed passed the screen in a substantially vertical direction relative to screen. The web is configured to at least substantially extend across the width of the cylindrical screen. So as to achieve the best possible printing effect, the screen (S) and web (W) are configured so as to be in mating contact during the printing mode. More specifically, the screen and web are configured such that a part of an outer (external) surface (S3) of the screen is in mating contact with a printing surface (W1) of the web during the printing mode. The point at which the printing surface (W1) and external surface (S3) mate may be referred to as the printing point (P). It can be seen from FIG. 2 that printing point P extends along the width of the screen.

Figure 7:
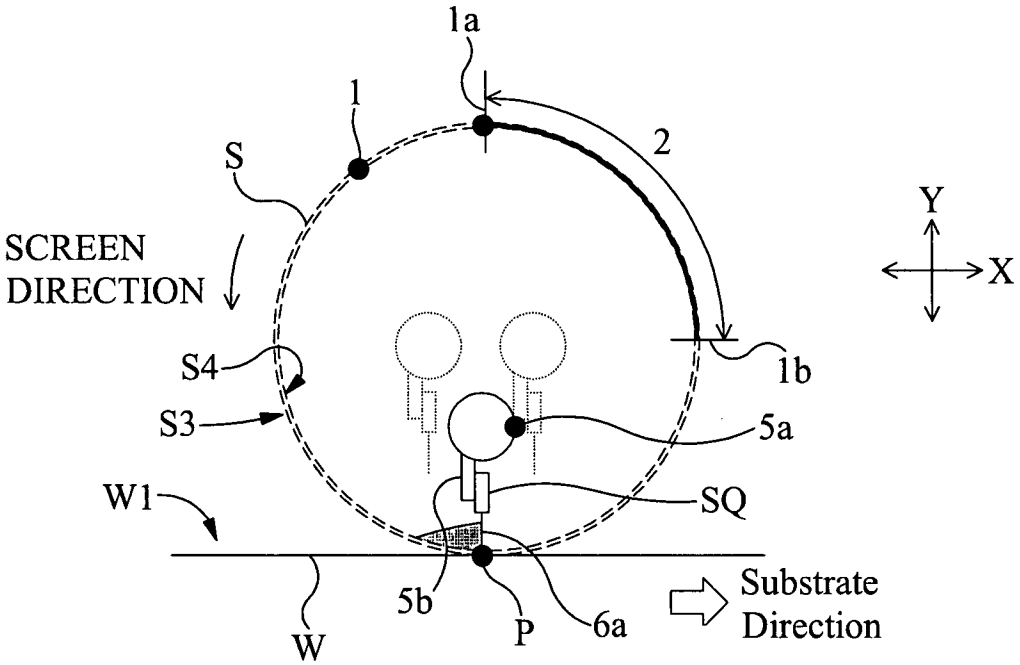
FIG. 7 is a cross-sectional schematic view showing how a squeegee can be adjusted with respect to the screen as depicted.

The screen may be mounted such that it always remains in mating contact with the web during the printing process (i.e. during both the printing modes and non-printing modes). Alternatively, the screen may be mounted using adjustable mounting means so as to adjust the position of the screen relative to the web. The adjustable mounting means preferably allow for movement in at least two different planes or directions, such as in direction X and Y as depicted in FIG. 7. As a result, the position of the cylindrical screen may be adjusted so as to achieve different printing effects. Also and alternatively, the cylindrical screen may be lifted, raised, retracted or moved away from the web so that it is no longer in mating contact with the web. The screen may be retracted when the cylindrical screen is in non-printing mode so as to help keep the non-printed region (that is formed on the web during the non-printing mode) free from ink. The adjustable mounting means may include servo, stepper or linear motors and/or a cam system to adjust the position of the screen. The adjustable mounting means are preferably dynamically responsive (i.e. change position quickly) and accurate to ensure the printing action of the screen is not compromised.

In the embodiment depicted in FIGS. 5*a* and 5*b*, the screen (S) is configured to rotate in an anti-clockwise direction. The web (W) is configured to move from left to right. FIG. 5*a* shows a part of the printing zone (1) in registration with (mating contact) the web at printing point P. The cylindrical screen is in printing mode thus, the permeable printing zone passes between the squeegee (SQ) and the web—such that ink can be transferred through the stencil to the web to print the desired image. FIG. 5*b* shows how the screen has been as rotated and the non-printing zone (2) is now in registration with the web at printing point P. As a result, printing has stopped. During the non-printing mode, the non-printing zone of the screen passes between the squeegee and the web such that ink can not be transferred through the impermeable wall to the web.

In the embodiment depicted in FIG. 6*a* the screen (S) is configured to rotate in an anti-clockwise direction. The web (W) is configured to move from left to right. FIG. 6*a* shows a first printing zone (100) in registration with the web. As the first printing zone passes over the web, ink will be transferred through the stencil of the screen and an image will be printed.

Figure 8:
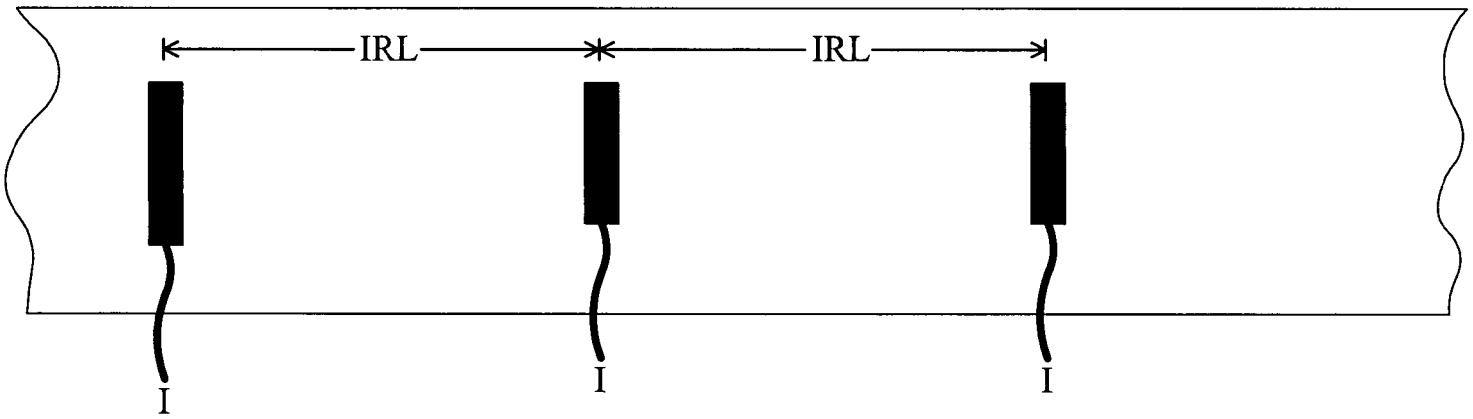
FIG. 8 is a view of an extract of a web that has been printed using a conventional printing station.

As explained above, the rotational speed of the screen in a conventional rotary screen printing system is at least substantially synchronised with the web line-speed throughout the entire printing process. Hence, image repeat length corresponds to the circumference of screen. FIG. 8 shows a part of a printed web under conventional screen printing conditions where the rotational speed of the screen is at least substantially synchronised with the web line-speed throughout the printing process. An image (I) is repeatedly printed on the web at regular intervals. The image repeat lengths (IRL) are identical to the circumference of the screen.

However, the present invention provides a printing method and apparatus for printing at least one image repeat whereby the image repeat length is greater than the circumference of the screen. According to the invention, an image repeat having an image repeat length that is greater than the circumference can be produced by controlling the rotational speed of the screen relative to the web during a non-printing mode such that the non-printed region formed on the web during the non-printing mode is longer than the circumferential length of the associated non-printing zone on the screen. The length of the non-printed region on the web may be extended with respect to the associated non-printing zone on the screen by slowing or stopping the screen with respect to the moving web during the non-printing mode. By slowing or stopping the screen with respect to the moving web, a length of web passes over the Screen such that when the printing recommences, the overall length of the web that has passed during the non-printing mode (the non-printed region on the web) is greater than the associated non-printing zone.

So as to produce an image repeat where the image repeat length is greater than the circumference of the screen, the rotation of the screen is preferably controlled to follow:

(i) a first motion profile during the printing mode(s) of an operating cycle (i.e. one complete revolution of the screen); and (j) a second, different motion profile during the non-printing mode or at least one non-printing mode (if there are a plurality of printing modes during an operating cycle) of the same operating cycle.

Under the first motion profile, the cylindrical screen is rotated at a predetermined printing speed so as to print at least one image on the web. Preferably the printing speed is maintained throughout the first motion profile. Preferably, the printing speed is a rotational speed that is at least substantially synchronised with the web line speed. When this occurs, the length of a printed region on the web is substantially equal to the circumferential length of the associated printing zone. Moreover, the size of the image printed in the printed region is at least substantially equal to the size of the stencil image. Alternatively, the predetermined printing speed of the screen may be a rotational speed that achieves a slip printing effect. For example, the printing speed of the screen may be lower than the nominal printing speed that synchronises with the web line speed so that the resulting printed image is stretched or elongated with respect to the stencil image. Alternatively, the printing speed may be higher that the nominal printing speed that synchronises with the web line speed so that the resulting printed image may be squat with respect to the stencil image.

Under the second motion profile, the rotation of the screen is controlled such that the length of the non-printed region in the repeat or repeat portion (if there is a plurality of non-printed regions) is longer than the circumferential length of the associated non-printing zone on the screen. This may be achieved by:

(i) reducing the rotational speed of the screen to a speed below the predetermined printing speed (e.g. substantially reducing the speed to a "creeping" speed) when the non-printing zone is in registration with the web;

(j) or alternatively stopping/suspending the rotation of the screen with respect to the moving web when a non-printing zone is in registration with the web.

By extending the length of at least one non-printed region on the web the overall repeat length is greater that the circumference of the screen.

Preferably, the screen is decelerated or stopped during an initial period of the second motion profile.

As part of the second motion profile, the rotational speed of the screen is preferably increased such that the screen is rotating at the predetermined printing speed as a subsequent printing region comes into registration with the web. Accelerating the rotation of the screen to printing speed prior to starting printing mode helps to maintain a high printing performance. Preferably, the screen is accelerated during the latter period of the second motion profile such that the speed of the screen is at least substantially synchronised with the speed of the web a short time before the screen enters printing mode.

Under the second motion profile the screen may be rotated in a reverse direction, at a predetermined speed, for a given period of time and at a predetermined time during the second motion profile. It has been found that the reverse motion helps to optimise the acceleration of the screen back up to the predetermined printing speed.

Figure 9:
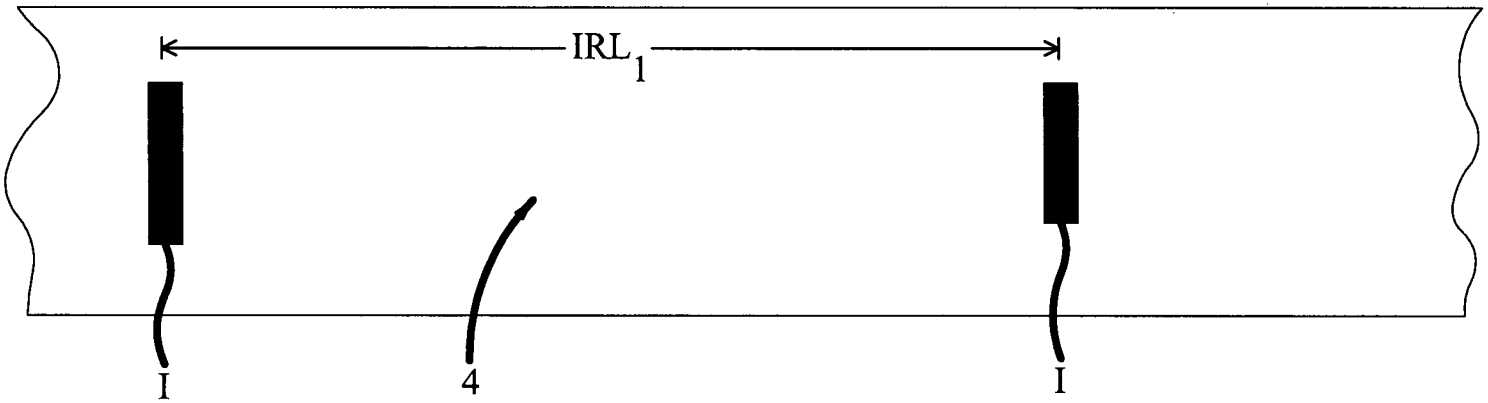
FIG. 9 is a view of an extract of a web that has been printed using the screen as depicted in FIGS. 5*a* and 5*b;*

FIG. 9 shows a part of a printed web (W) that has been produced by the embodiment of the screen as depicted in FIGS. 5*a* and 5*b*. An image (I) has been repeatedly printed on the web at regular intervals. The images (I) were formed on the web as the printing zone of the screen passed across the web under a first motion profile. Under the first motion profile, the screen was rotated at a printing speed that substantially synchronised with the web line speed. The non-printed regions (4) were formed on the web as the associated non-printing zone of the screen passed over the web under a second, different motion profile. Under the second motion profile, the rotational speed of the screen was initially substantially reduced for a predetermined period of time such that it had a creeping motion with respect to the moving web. During this time, a predetermined amount of web moved across the screen. Towards the later part of the second motion profile, the rotation of the screen was accelerated such that it was rotating at the printing speed when printing mode started again (as the printing zone came back into registration with the web). Due to the second motion profile, the non-printed regions (4) are longer than the circumferential length of the non-printing zone (2) of the screen. Hence, the repeat length (IRL1) is greater than the circumference of the screen.

The second motion profile of the screen is dependent on the required length of the non-printed region. This, in turn, is dependent on the printing technique being utilised and the nature of the design being printed. Under the second motion profile, the rotation of the screen may be controlled so as to achieve any desired image repeat length or repeat portion length. By controlling the rotation of screen during the non-printing mode (e.g. controlling the time intervals between slowing/suspending rotation and recommencing rotation and/or by controlling the variation in the rotational speed during the non-printing mode) it may be possible to print a web where the repeats/repeat portions have at least substantially identical repeat lengths/repeat portion length (as shown in FIGS. 5*c* and 6*b*), variable repeat lengths/repeat portion lengths or random repeat lengths/repeat portion lengths.

By controlling the rotation of the screen as described a printing system comprising a plurality of printing stations according to the invention can implement different printing techniques that may be suitable for producing designs having a large size format, multiple images having large separations.

Further information relating to the effects, advantages and different types of printing techniques that may be achieved by controlling the rotation of the screen such that the repeat length is greater than the circumference of the screen is provided in more detail below.

Arranged within the screen is an ink delivery means to deliver or supply ink to an inner (internal) surface (S4) of the cylindrical screen. The ink delivery means is suitable for supplying any fluid that is suitable for printing purposes such as ink, dye, paint etc. The ink delivery means comprises an ink feeding tube (5*a*) that extends through the screen in a direction parallel to the longitudinal axis of the screen and protrudes from at least one end of the screen. Hence, the ink feeding tube feeds ink across the width of the screen. The ink may be directed towards the inner surface of the screen via apertures formed in the ink feeding tube. Alternatively, the ink delivery means may further comprise one or more ink guides (e.g. tubes or nozzles (5*b*) as depicted in FIGS. 5*a*, 5*b*, 6*a* & 7) to direct or guide the ink towards the inner surface (S4) of the screen. It can be seen from FIGS. 5*a*, 5*b*, 6*a* and 7 that the ink collects in a region on the inner surface (S4) of the screen adjacent the squeegee.

A squeegee (SQ) is also arranged within the screen to help transfer ink through the permeable stencil to the web so that an image can be printed. The squeegee is configured to apply a pressure towards the inner surface (S4) of the screen such that when the impermeable stencil is arranged between the squeegee and the inner surface the squeegee squeezes, pushes or forces ink through the stencil. The squeegee comprises a squeegee blade (6*a*) with an edge portion (6*b*). The squeegee blade is configured such that the edge portion (6*b*) extends at least substantially across the width of the screen in a direction a parallel to the longitudinal axis of the screen. In operation, the edge portion (6*b*) of the squeegee blade is arranged in mating contact with the internal surface (S4) of the cylindrical screen. Thus, as the screen (1) is rotated the squeegee blade (6*a*) moves across the ink and the internal surface of the screen. The edge portion (6*b*) of the squeegee blade applies a pressure along a mating contact line on the internal surface such that, when the printing zone passes between the web and edge portion, ink can be pushed through the permeable stencil and an image can be printed on the web.

The ink delivery means and squeegee may be separately formed and separately configured, separately formed and coupled together or integrally formed. In the embodiment depicted in FIGS. 1-4, the ink delivery means and squeegee are integrally formed. The position of the squeegee is preferably adjustable using adjustable mounting means. The adjustable mounting means preferably allow for movement in at least two different planes or directions, such in direction X and Y as depicted in FIG. 7. As a result, the pressure applied to the internal surface (S4) by the edge portion (6*a*) of the squeegee blade may be adjusted so as to achieve a different printing effect. Also or alternatively, the squeegee may be lifted, raised, retracted or moved away from the screen so that the edge portion (6*a*) of the squeegee blade is no longer in mating contact with the internal surface (S4). When the edge portion is no longer in mating contact with the internal surface the amount of ink that permeates through the stencil is at least substantially reduced. The position of the squeegee may be controlled during an operating cycle of the screen such that the squeegee is lifted and moved away from the internal surface of the screen during non-printing mode (when at least a portion of the non-printing zone of the screen passes across the web) and then returned to its original position to provide a requisite pressure on the internal surface of the screen just prior to the start of the printing mode (when the printing zone comes into registration with the web).

By raising or retracting the squeegee as such, the risk of ink contamination in the non-printed region of the web is reduced. Another potential advantage of lifting the squeegee so as to reduce pressure or retract the squeegee so as to remove pressure during the non-printing mode is to reduce the abrasion between the moving web and outer surface (S3) of the screen which is rotating at a speed other than the web speed. Additionally, the possibility of "smudging" ink printed during previous printing modes is reduced.

If provided, the adjustable mounting means are preferably dynamically responsive and the adjusting action is closely integrated with the operation cycle of the screen so as to ensure accurate and high quality printing. The adjustable mounting means may comprise a servo, stepper or linear motor and/or pneumatic cylinder or a cam system to appropriately adjust the position of the squeegee. The squeegee and screen may both be retracted away from the web during the non-printing mode. The squeegee and screen may share the same adjustable mounting means to adjust the position of the squeegee and/or screen.

Since the screen has a relatively low weight, it is possible to design a drive system which is very accurate but of low power. In a preferred implementation, separate motors drive the two ends of the screen so as to eliminate twist between the ends (which could lead to screen breakage). By using separate motors along timing pulleys and belts (rather than gears) to drive each end of the screen this drive system also gives an improved print register, it minimises the stress on the screen during printing mode and non-printing mode operating cycle, it reduces the costs of the printing station due to the elimination of idler-gears and cross-shaft etc., it is easy to assemble, it improves the allowable printing rate (for example, to approximately 80 m per min), and is quieter to operate.

In the embodiment depicted in FIGS. 1-4, the drive system comprises a first drive means to drive the first end of the screen (Si) and a second drive means to drive the second end of the screen (S2) . The first drive means comprises a first drive head (H1) to couple the first end of the screen and a first motor (not shown). The second drive means comprises a second drive head (H2) to couple the second end of the screen and a second motor (not shown). The first drive head (H1) comprises a first retaining means (RM1) to retain the first end portion (S1) of the screen and a first driving axle (DA1) to rotatably drive the screen. The first driving axle is, in turn, driven by the first motor (not shown) via a pulley and belt arrangement (B1). The second drive head (H2) comprises second retaining means (RM2) to retain the second end portion (S2) of the screen and a second driving axle (not shown) to rotatably drive the screen. The second driving axle is, in turn, driven by the second motor (not shown) via a pulley and belt arrangement (B2).

Preferably, the end portions of the screen comprise female connecting means and the retaining means comprise, male receiving means. For example, the female end portions of the screen may comprise a bayonet fitting that is configured to be received by a male receiving ring.

The drive system further comprises control means to synchronise the driving action of the first drive means and the second drive means and control the rotational speed of the screen during the operational cycle. More particularly, the control means controls the rotational speed of the screen such that the image repeat length of the repeat is longer than the circumference of the screen. Even more particularly, the control means controls the rotational speed of the screen such that the screen follows a first motion profile during a printing mode so as to print an image on the web and a second different motion profile during a non-printing mode such that the image repeat length is longer than the circumference of the screen.

As explained previously, under the first motion profile, the rotation of the screen is controlled so that the screen rotates at a predetermined printing speed to print at least one image on the web. Preferably the predetermined printing speed is maintained throughout the first motion profile. Preferably, the predetermined printing speed is a rotational speed that is at least substantially synchronised with the web line speed. When this occurs, the length of a printed region on the web is substantially equal to the circumferential length of the associated printing zone. Moreover, the size of the image printed in the printed region is at least substantially equal to the size of the stencil image. Alternatively, the predetermined printing speed of the screen may be a rotational speed that achieves a slip printing effect. For example, the printing speed of the screen may be lower than the nominal printing speed that synchronises with the web line speed so that resulting printed image is stretched or elongated with respect to the stencil image. Alternatively, the printing speed may be higher that the nominal printing speed that synchronises with the web line speed so that the resulting printed image may be squat with respect to the stencil image.

As explained previously, under the second motion profile, the rotation of the screen is controlled such that the length of the non-printed region in a repeat or at least one repeat portion (in the case when there is plurality of non-printed regions on the screen) is longer than the circumferential length of the associated non-printing zone on the screen. This may be achieved by:—

(i) reducing the rotational speed of the screen to a predetermined reduced speed below the predetermined printing speed (e.g. to a "creeping" speed), for a predetermined period of time when a non-printing zone is in registration with the moving web; or (i) stopping or suspending the rotation of the screen with respect to the moving web for a predetermined period of time when a non-printing zone is in registration with the web.

Preferably, the rotation of the screen is controlled such that it is decelerated or stopped during an initial period part of the second motion profile.

So as to ensure the image is appropriately printed during the subsequent printing mode, it is preferable to control the motion of the screen such that it is already rotating at the predetermined printing speed prior to starting the printing mode. This is achieved by increasing the rotational speed to the predetermined printing speed during a later period of the second motion profile. Optionally, motion of the screen may be controlled to undergo a small reversal of rotation (for a predetermined period of time, at a predetermined speed and at a predetermined time during the second motion profile) so as to help optimise the acceleration of the screen to the predetermined printing speed.

The rotary printing station comprises a web line means to feed a web through the station and past the screen. In the embodiment depicted in FIGS. 1-4, the web line means comprises a roller to support and guide the web along a printing track relative to the screen.

The rotary printing station may further comprise a cleaning system to scrape or clean the outer surface (S3) of the screen. The cleaning system may comprise a lip (L) that is mounted in mating contact with the outer surface (S3) screen and extends across the width of the screen in a direction parallel to the longitudinal axis of the screen. Thus, as the screen rotates with respect to the lip, the lip scrapes the outer surface of the screen so as to at least substantially remove waste products such as excess ink and/or debris. It is preferable for waste products to be removed from the outer surface of the screen so as to maintain printing quality. A drip tray (DT) may be arranged below the screen to as to collect waste products scraped from or falling from the screen.

Figure 10B:
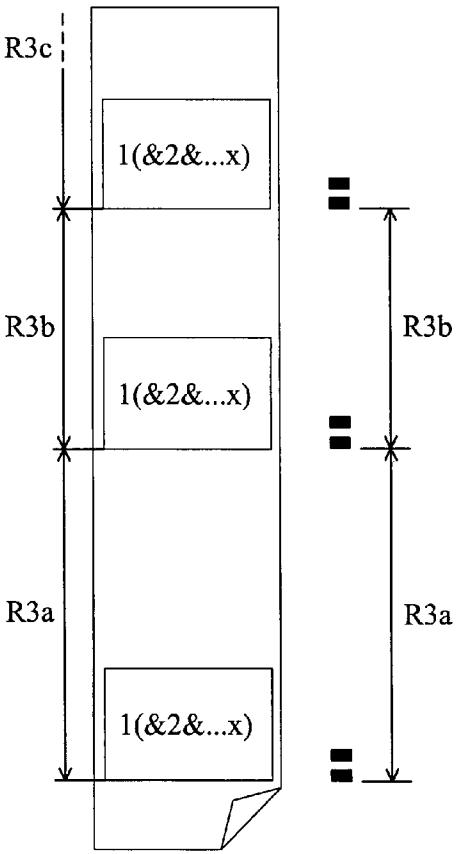
FIGS. 10*a* and 10*b* depict extracts of two webs that have been "marked" so as to accurately align a printing zone of the screen with respect to a desired printing region on the web.
Figure 10A:
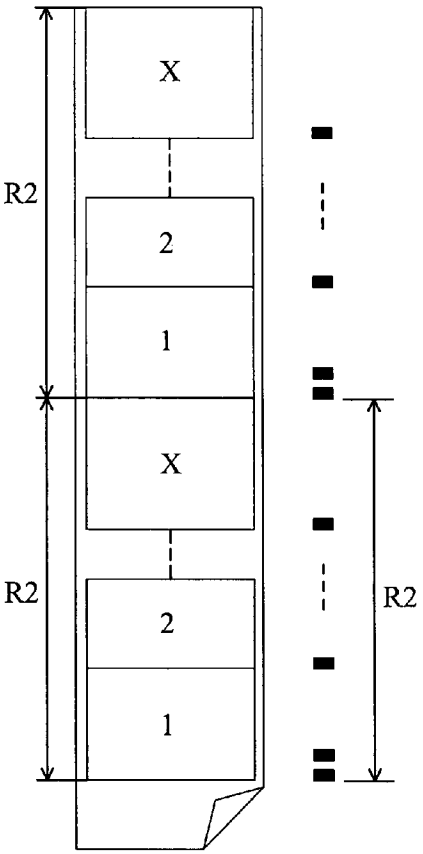

The rotary printing station may comprise an automatic registration system so as to register the position of the web relative to the rotational position of the screen. Preferably, the automatic registration system is a "key-mark" registration system where a small mark (or marks) is printed/etched on the web within the trim area. Preferably, the mark is printed on the rear, under-surface of the web so as to maximise contrast and enhance printing performance. The mark may be ink-jet printed on the web by ink-jet printing means. A photo-sensor is incorporated to detect the mark. If required, control means (e.g. drive control means) will initiate a phase adjustment of the screen in order to bring the image to be printed into registration with the mark. Alternative systems control also register by reference to previously printed marks. However, in the present invention utilisation of such a system would lead to reduced overall registration performance and be difficult to implement. This is because the previously printed marks only occur once every image repeat. Under the present invention, marks may be printed at any spacings as required by the design, for example at any desired printed region. As a result, multiple images can be printed more accurately on a web. For example, due to this improved registration system, a continuous series of images may be sequentially and accurately printed on a web without any substantial registration problems. Moreover, if a half drop design is required where a design extends horizontally across a wall, images printed on a first web may be matched or aligned more accurately to the corresponding images on the second web. In the web depicted in FIG. 10*a*, the repeat comprises a printed region 1 and then, in the non-printed region associated with region 1, a series of sequentially printed images in printed regions 2 . . . X. For ease, the registration marks printed on the underside of the web are depicted along side the web. It can be seen that a mark is printed adjacent each printed region so as to indicate where each printing zone (1, 2 . . . X) must be located. Hence, each printed region is accurately aligned and positioned with respect to the previous printed region so as to form a continuous series of images. A different mark is printed to indicate the first printed region of the repeat. In the web depicted in FIG. 10*b*, where the repeat comprises a series of overlaid printed images 1, 2, . . . X in a single printed region and a non-printed region, a mark is printed to indicate the location of the printed region. Due to the marks, each image is accurately overlaid with respect to the previous image. It can be seen in FIG. 10*a* that the image repeat lengths R2 of the web are identical whereas in FIG. 10*b* the image repeat lengths are variable R3*a*, R3*b* and R3*c*. By utilising the key mark registration system as described the rotary printing station according to the invention has a registration of +/−0.25mm.

Figure 11B:
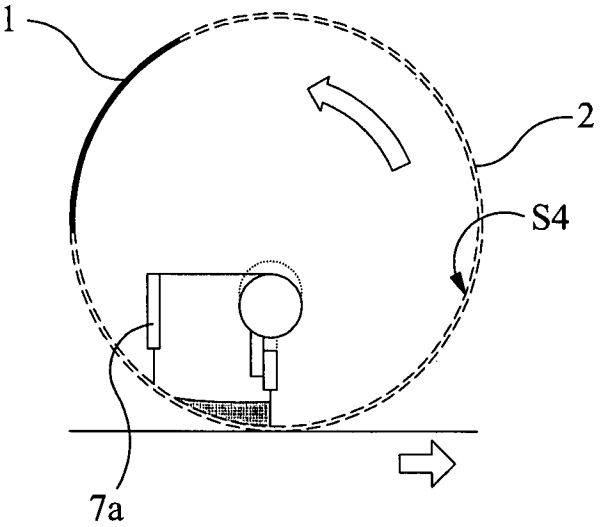
FIGS. 11*a* and 11*b* are cross-sectional schematic views showing a containment chamber mounted in the screen as depicted in FIGS. 5*a* and 5*b;*
Figure 11A:
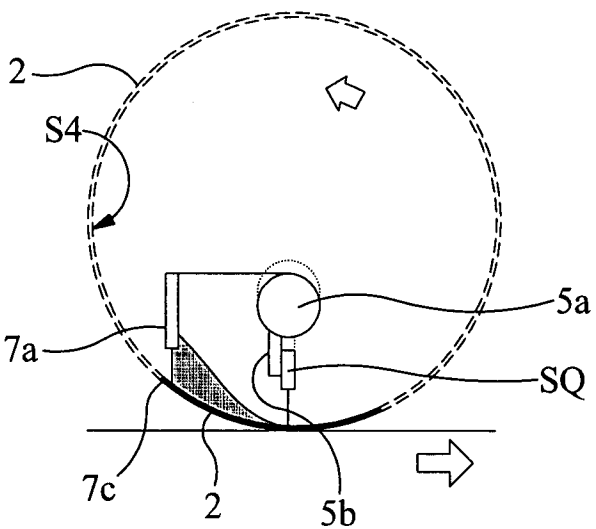

It is known and understood that, during operation, a volume of ink collects on the inner surface (S4) of the screen adjacent the squeegee blade. This volume of ink becomes particularly significant during the non-printing mode when the non-printing zone is passing between the web and squeegee blade and not ink can be directly transferred to the web. It has been found that when the non-printing zone slows, stops or reverses during the non-printing mode (due to second motion profile) there is a risk that ink collecting on the impermeable, non-printing zone will flow back onto a permeable printing zone and thereby leak to the web. Accordingly, the rotary printing station according to the present invention may comprise a containment means to contain ink lying on the inner surface of the screen. In the embodiment depicted in FIGS. 11*a* and 11*b*, the containment means comprises a blade (7*a*) with an edge portion (7*c*) that is arranged in mounting contact against the inner surface (S4) of the web. The mating point of the containment blade on the inner surface of the web is spatially located at a predetermined distance from the mating point of the squeegee blade on the inner surface of the web. The squeegee blade, containment blade and inner surface of screen define a containment chamber so as to contain the ink within a particular region on inner surface (S4) of screen. The containment chamber is specifically configured so as to at least substantially retain the ink within the impermeable non-printing zone of the screen during the non-printing mode. Hence, the flow of ink towards a permeable, printing region during the second motion profile is at least restricted. Due to the containing effect provided by the containment chamber, the circumferential length of the non-printing zone on the screen may be minimised. This in turn maximises the available printing zone and ultimately the available image size. The containment means may further comprises a probe (7*b*) to detect the position and/or volume of ink within the containment chamber Any other suitable wall-like, enclosure or sealing structure may be provided to form a containment chamber to retain ink in a predetermined region on the screen with respect squeegee blade (6*a*).

Another aspect the invention relates to a rotary printing system comprising a plurality of rotary printing systems, whereby at least one rotary printing station system is rotary printing system as described above. A plurality of rotary printing stations may be arranged in tandem so as to consecutively feed a web to each of the printing stations so as to print a design comprising multiple images (e.g. images have different shapes and/or colours). This type of printing system further comprises means for transferring the web to the different print stations.

In preferred embodiments of a system comprising a plurality of printing stations whereby all the screens of the stations are electronically geared to an electronic line shaft (a master controller). The electronic line shaft gives close control of the speed and angular positions of the screens in each printing station. Hence, the screens are dynamically responsive, run smoothly and are accurately synchronised with respect to one another. The drive signals generated by the electronic line shaft are preferably implemented using a high speed communications network. Manipulation of the screens by the electronic line shaft allows for multiple image/multiple colour printing techniques as described above. Additionally, the use of electronic line technology enables improved accuracy print registration and allows for simple integration of automatic register control systems for further improvement.

The electronic line shaft effectively replaces the common mechanical line shaft where each drive system runs in a geared synchronous relationship with a master. In the present invention, a master oscillator circuit may be provided to implement the modulation of the electronic line shaft or alternatively, this may be achieved by software at a drive control means.

Examples of different printing techniques and effects that can be achieved by controlling the rotation of the screen such that the image repeat length is greater than the circumference of the screen shall now be described.

Figure 12A:
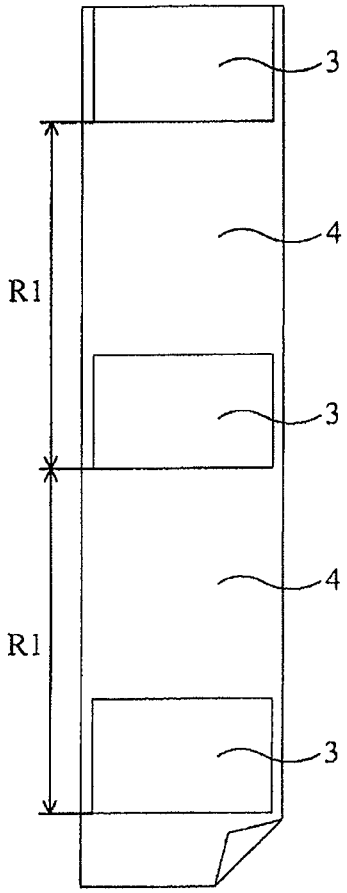
FIGS. 12*a* to 23*c* depict extracts from webs showing examples of different print designs and techniques that are achievable using the present invention.
Figure 12B:
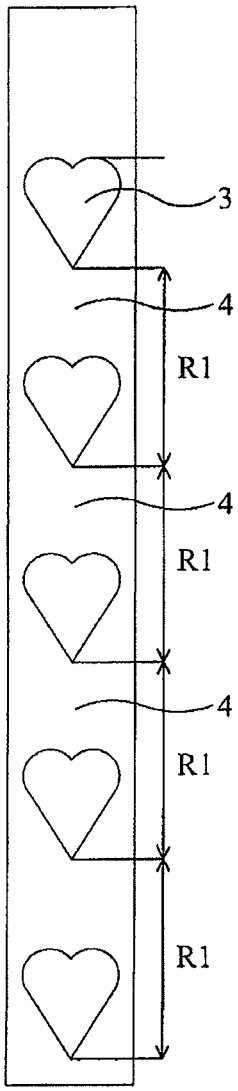

FIGS. 12*a* and 12*b* depict an example of a web having a fixed repeat design —that is, design comprising a plurality of repeats where the repeat length is fixed to a predetermined value that is greater than the circumference of the rotary printing screen. In this case, the image repeatedly printed on the web at regular intervals is a love heart. This web has been printed using a screen having a single printing zone and a single non-printing zone (as shown in FIGS. 5*a* and 5*b*). The rotation of the screen has been controlled so as to produce a series of consecutive repeats, whereby each repeat comprises a printed region (3) and a non-printed region (4). The image repeat length R1 that is greater than the circumference of the screen. The rotation of the screen has been controlled to ensure the repeat length of each repeat is a least substantially similar.

Figure 13A:
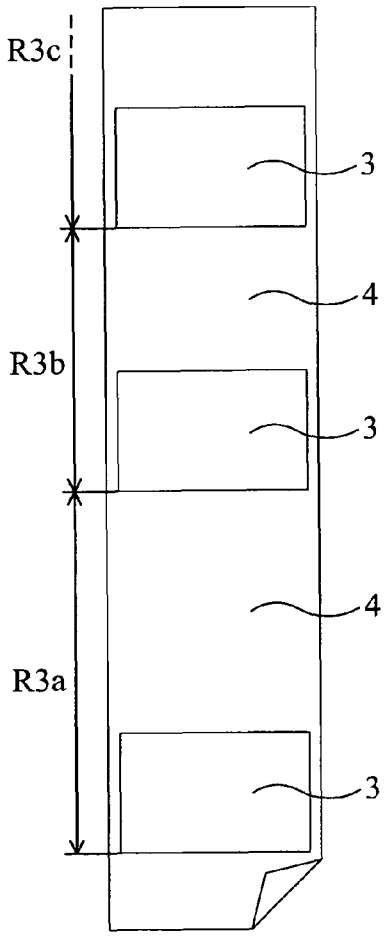
Figure 13B:
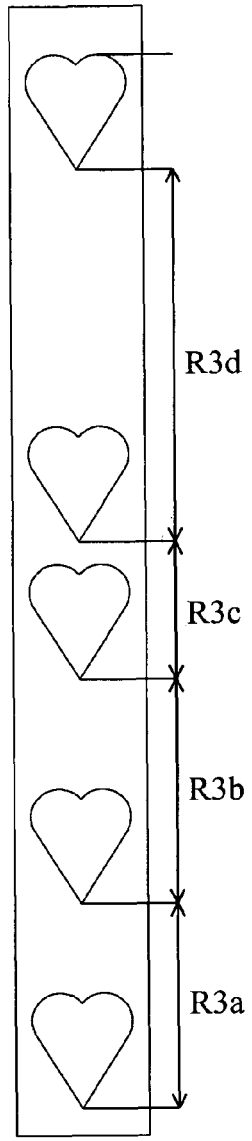

FIGS. 13*a* and 13*b* depict an example of a web having a variable repeat design—that is a design comprising a plurality of repeats where the repeat length varies. In this case, the image repeated printed on the web, but arranged at various intervals, is a love heart. This web has been printed using a single screen having a single printing zone and a single non-printing zone (as shown in FIGS. 5*a* and 5*b*). The rotation of the screen has been controlled so as to produce a series of repeats, whereby each repeat comprises a printed region (3) and a non-printed region (4). The rotation of the screen has also been controlled to vary the length of each non-printed region so as to provide different repeat lengths (R3*a*, R3*b*, R3*c*, R3*d* etc.) for every repeat. Moreover, the rotation of the screen has been controlled so that certain repeat lengths (e.g. R3*b* and R3*d*) have a repeat length that is longer than the circumference of the screen.

Figure 14A:
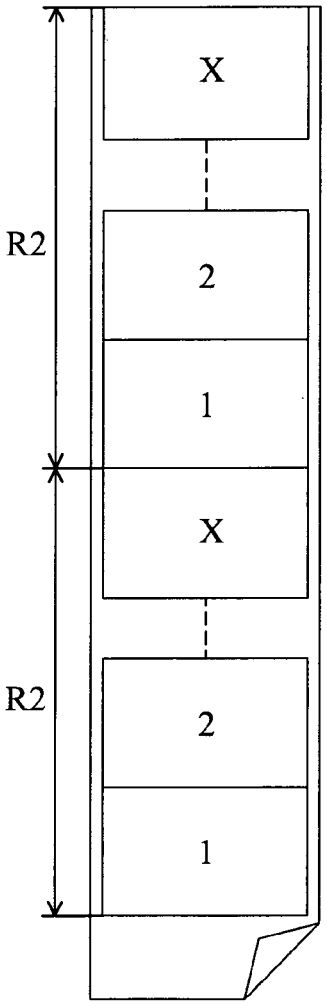
Figure 14B:
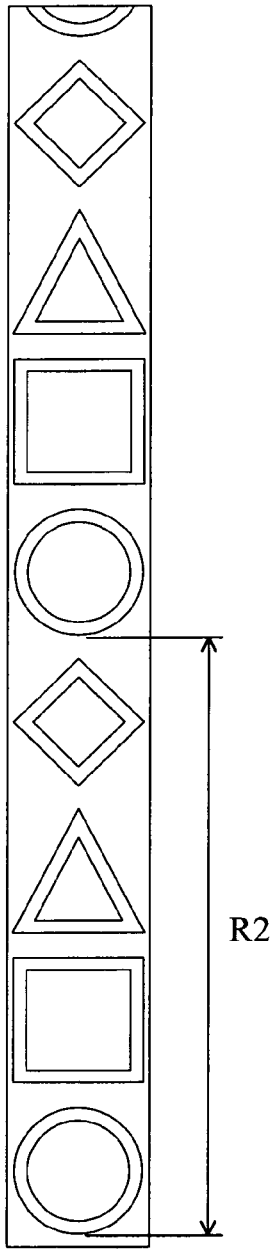

FIGS. 14*a* and 14*b* depict an example of a web having a design comprising a repeating series of multiple (four) images—that is, a design comprising a plurality of repeats where the repeat length is large enough to allow a series of three other images (e.g. square, triangle and diamond) to be printed in the non-printed region of the first repeat (e.g. circle). The repeat length for each different image is fixed and it is greater than the circumference of the rotary printing screen. This web has been printed using four different screens. Each of the four screens has a single printing zone and a single non-printing zone and prints a different image (e.g. a circle, a square, a triangle and a diamond). The rotation of each screen has been controlled so as to produce a continuous series of repeats in which each of the printed regions follow consecutively 1, 2, 3, 4.

Figure 15A:
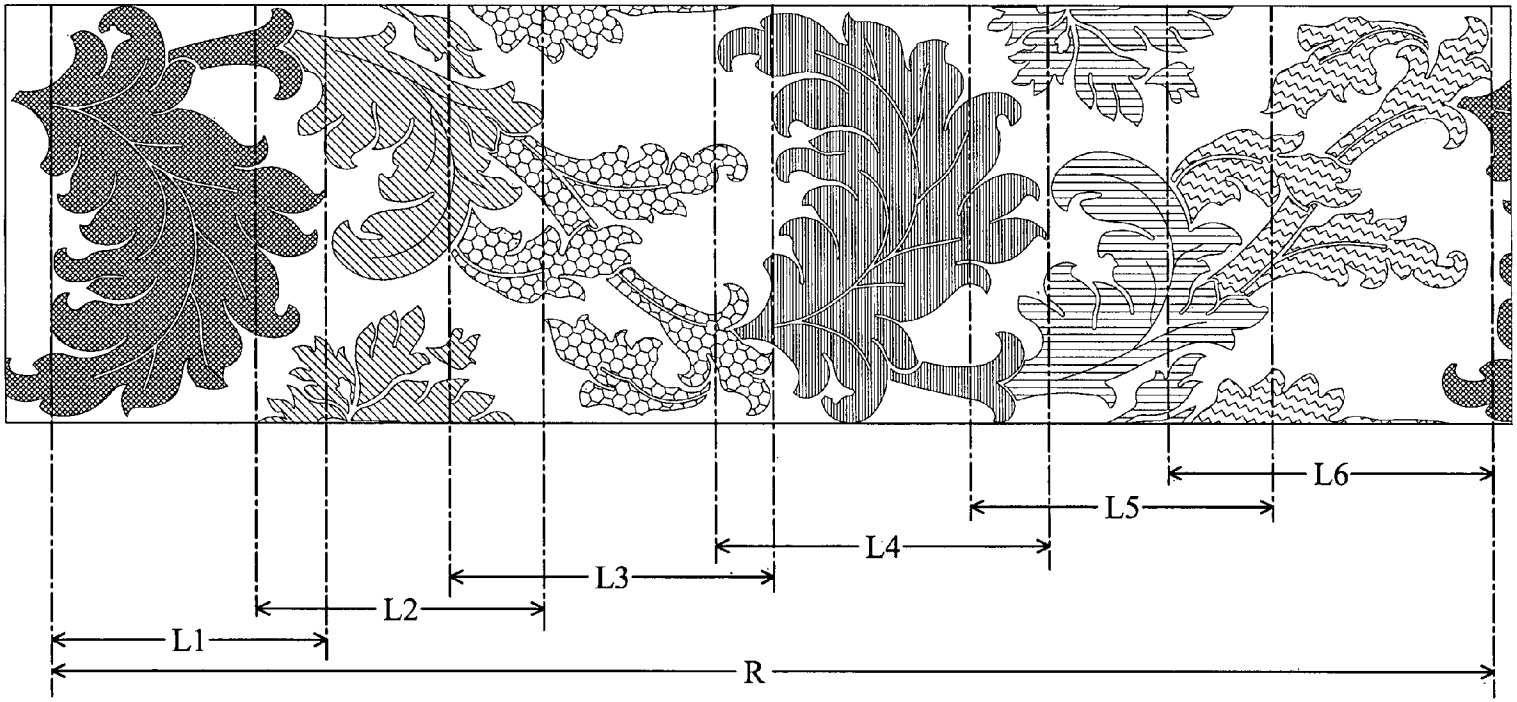
Figure 15B:
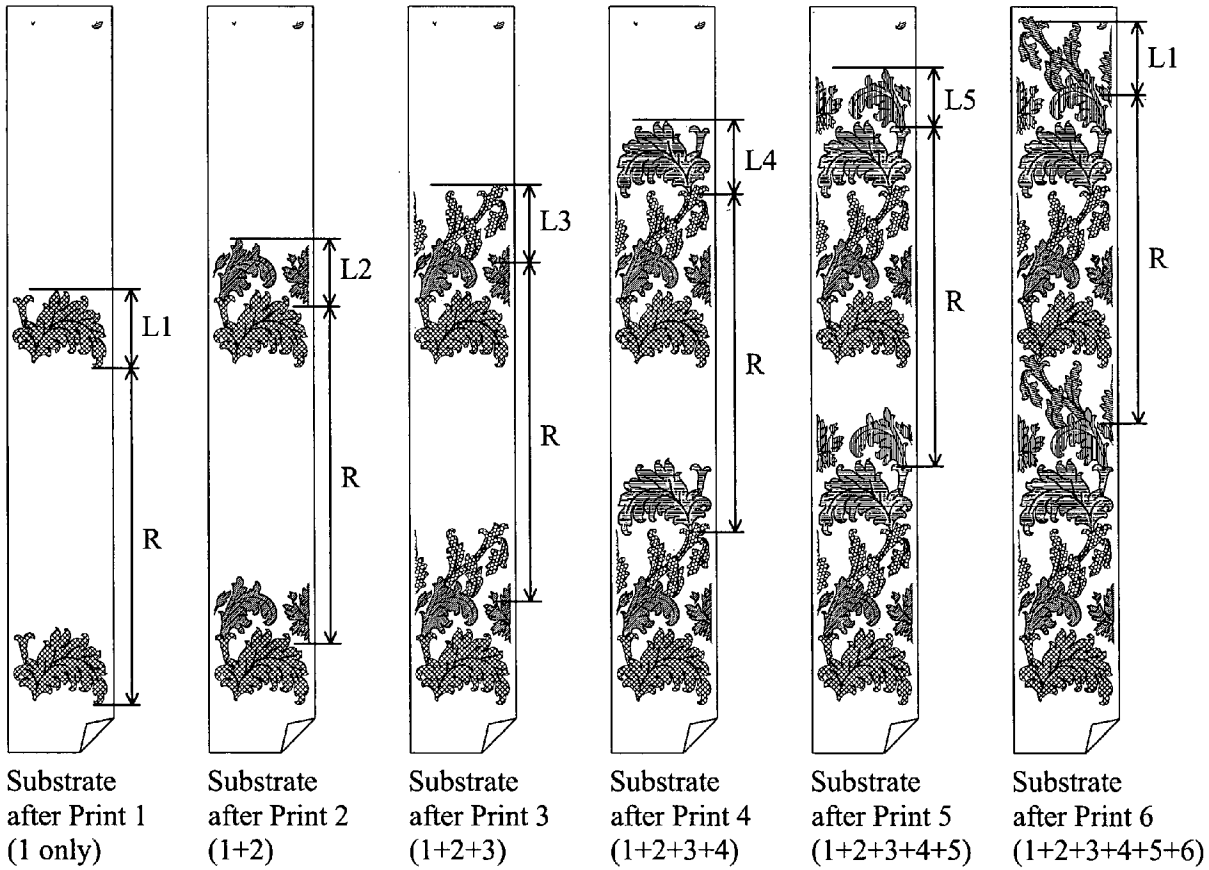

This type of printing technique is further illustrated by the webs depicted in FIGS. 15*a* and 15*b*. Here the web has been printed by six different screens whereby each screen prints a different leaf image (L1-L6). The repeat length for each different image is fixed (R) and it is greater than the circumference of the rotary printing screen. It can be seen clearly in 15*b* how the leaf design is sequentially built up by printing each image in turn. It is critical that each leaf image is accurately aligned with respect the previous leaf image. Therefore each image is accurately registered using the key mark registration system so as to ensure best possible printing performance.

Figure 16:
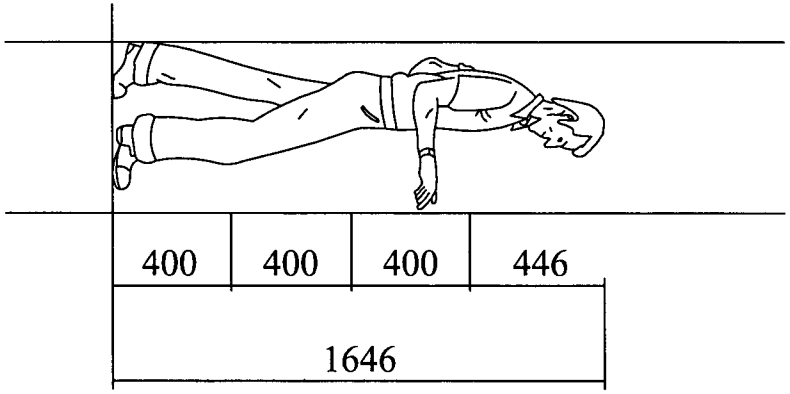

In FIG. 16, depicts another example of printing a series of consecutive images to form a design. In this case, four different screens have been used sequentially to systematically build up the design of the man. By using the key mark registration system the four different images are accurately aligned so as to provide a good quality design, Each of the printed regions of each repeat are at least substantially the same in length. By sequentially building up the images of the design a substantially wall height design may be produced.

Figure 17B:
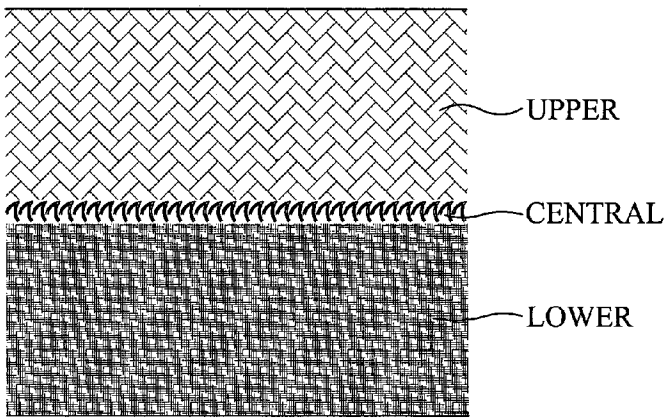
Figure 17A:
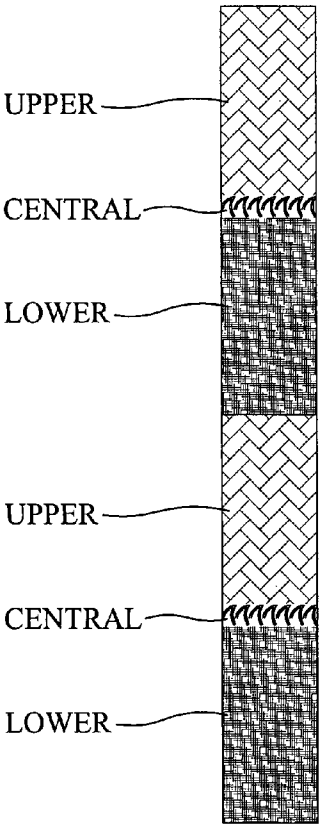

FIG. 17*a* depicts a continuous web that has been printed to include a design with a central border section. The web has been printed using three different screens whereby each screen prints a different image. The images have a different size of printed region and different pattern image. In the Figures, the design comprises an upper image, central image and lower image. The three different images are sequentially printed with no gap space there between. FIG. 17*b* depicts the mural effect to the design. This design may be suitable as a wall covering where a central border region is desirable.

Figure 18B:
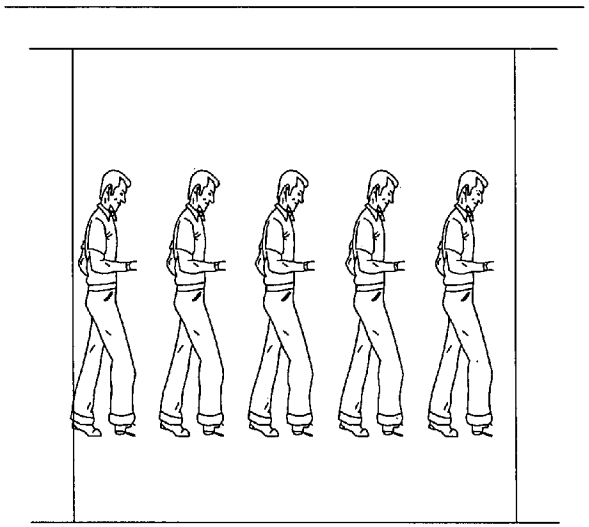
Figure 18A:
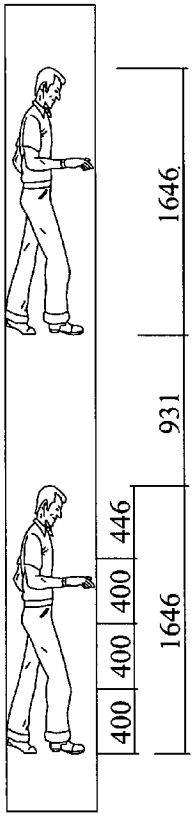

FIG. 18*a* depicts a continuous web that has been repeatedly printed by the four different screens to produce at least two images of the man. FIG. 18*b* depicts how sections of the continuous web may be cut and pasted on a wall to provide a full wall height mural effect.

Figure 19:
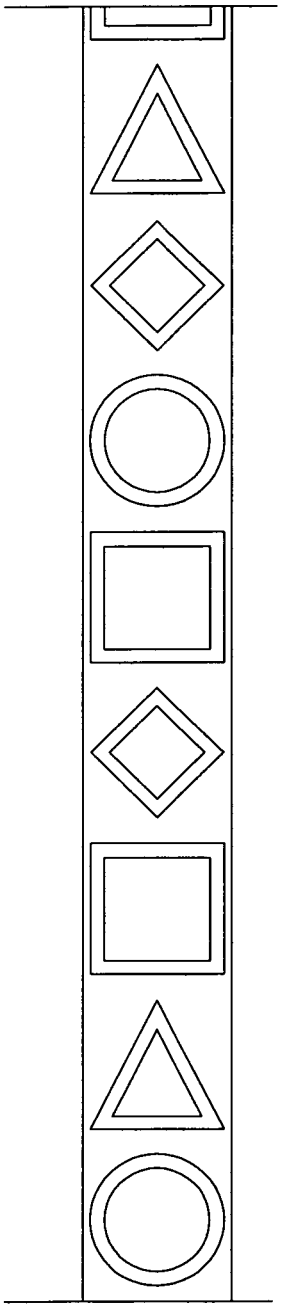
Figure 20D:
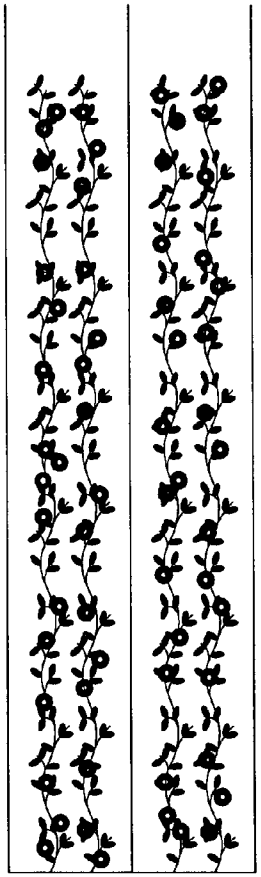
Figure 20C:
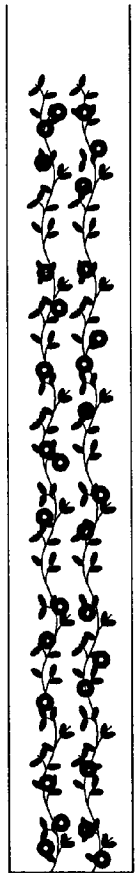
Figure 20B:
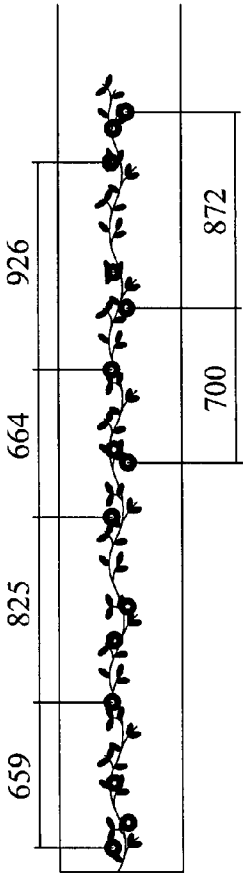
Figure 20A:
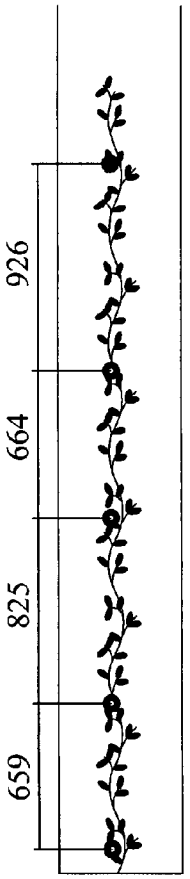

FIGS. 19 and 20*a*-*d* depict a random pattern. It can be seen in FIGS. 20*a* to 2*d* how a random design may be created by randomly selecting different images from plurality of different screens. In FIG. 19, the length of the printed regions is fixed. However, since the repeat length is variable the random printing options are available.

Figure 21C:
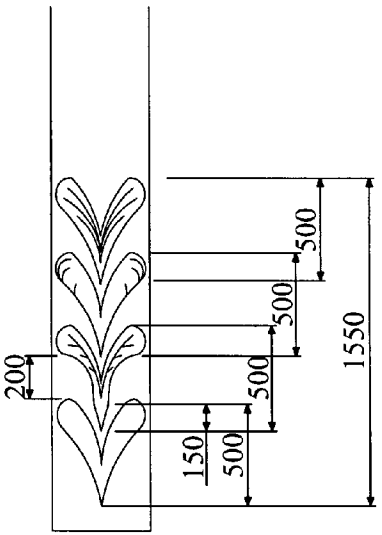
Figure 21B:
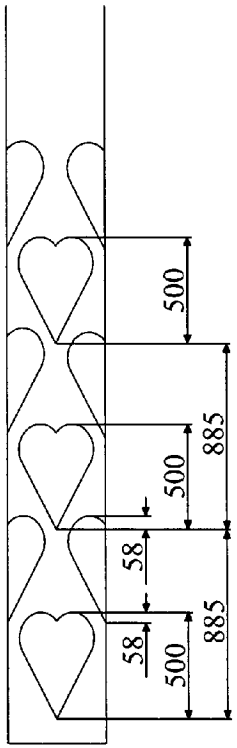
Figure 21A:
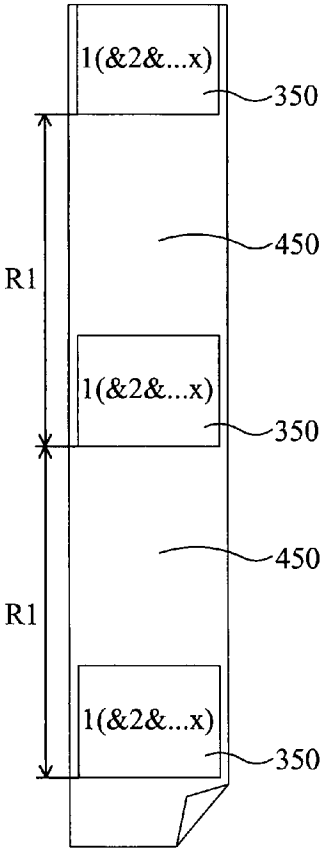

FIGS. 21*a* to 21*c* depicts a web where a plurality of images have been overlaid or staggered with respect to one another.

In FIG. 21 a, X screens print a different image in the same printed region (350). The resulting design comprises a plurality of overlaid images. This effect is achieved by controlling the rotation of the screens such that they always initiate printing mode on the same location of the web, they also have the same image repeat lengths. FIG. 21*b* depicts a web where love heart images have been printed on a web in an overlaying, staggered manner. This may be achieved by printing an image (forming a printed region) in a later part of the non-printed region a previous image. FIG. 22*c* depicts a leaf design whereby four leaf shapes have been printed on the web and further printing details have been directly printed over certain leaves.

Figure 22:
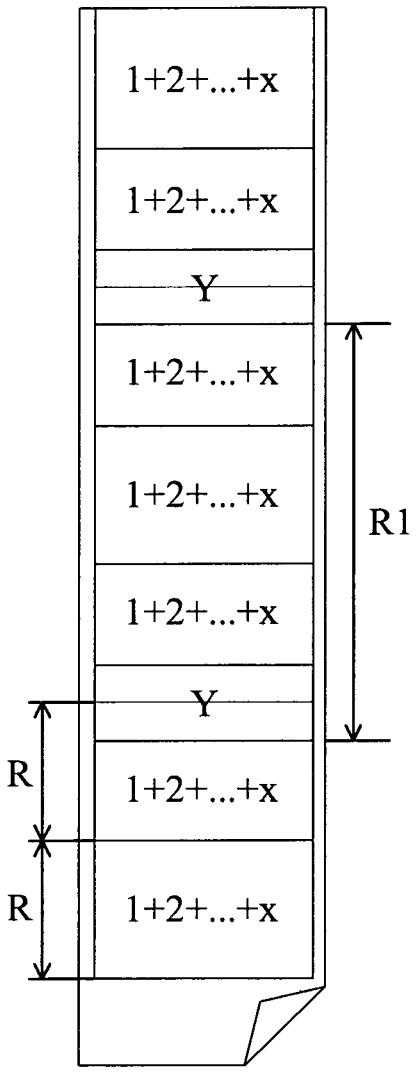

FIG. 22 depicts an example of a conventional web that has been overprinted by a random design Y having an image repeat length R1.

Figure 23C:
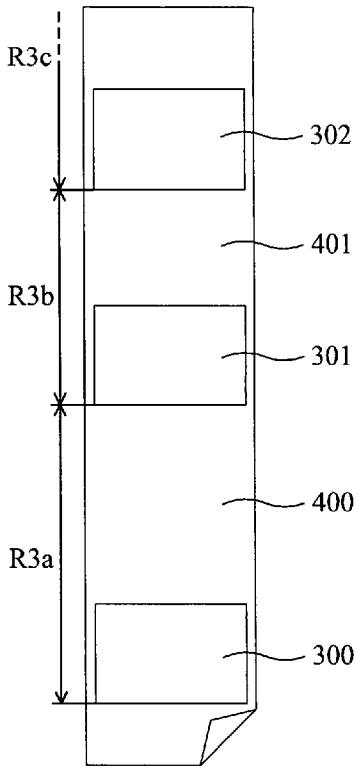
Figure 23B:
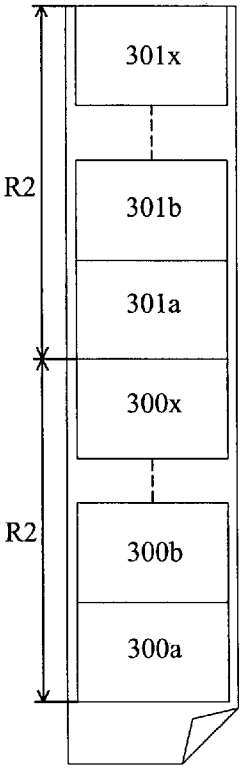
Figure 23A:
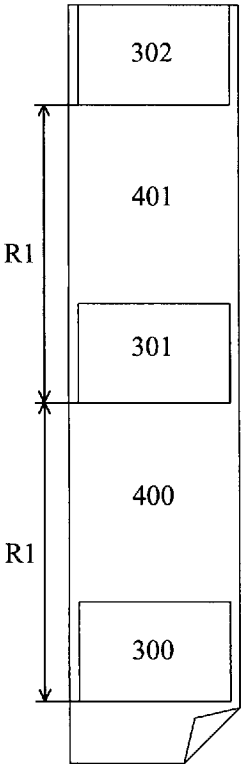
Figure 24:
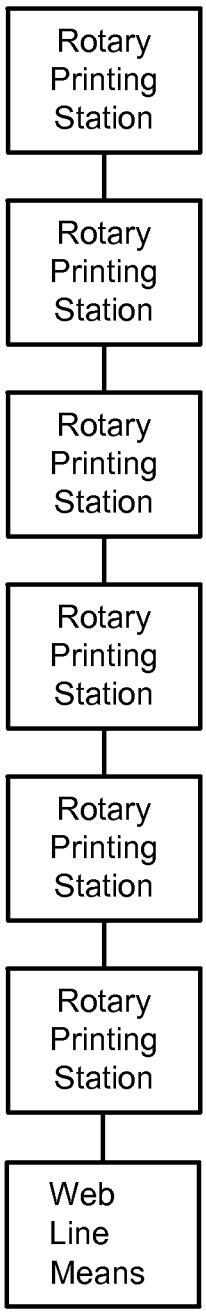
FIG. 24 depicts a plurality of rotary printing stations.

FIGS. 23*a* to 23*c* depict three different webs that have been printed using a screen comprising three printing zones and three non-printing zone (as shown in FIG. 6*a*), In FIG. 23*a*, the rotation of the screen has been controlled so as to print three equally spaced repeat portions (print region 300 and non-printed region 400 forms the first repeat portion etc). FIG. 23*b* depicts a web where x screens (each having three printing zone and three non-printing zones) have been utilised to form a design comprising a repeating succession of different images. Finally, FIG. 23*c* depicts a web that has been printed using a single screen having three printing zone (300, 301, 302) and three non-printing zones (400, 401, 402) whereby the non-printing regions vary in length.

A further aspect of the invention provides a web prepared using a rotary printing station according to the invention described above.

A further aspect of the invention provides a web prepared using a rotary printing system according to the invention described above.

A further aspect of the invention provides a web prepared using a method for printing a web according to the invention described above.

A further aspect of the invention provides a web prepared using a method for printing a design on a web according to the invention described above.

A further aspect of the invention provides a station or a system substantially as shown in the FIGS. and described herein. A further aspect of the invention provides a method substantially as shown in the FIGS.and described herein As explained previously, the present invention provides for the printing a designs that may have a large size format, that may have multiple images, may have images that are substantially spaced apart, that may have randomly located images, that may have overlaid images etc. Moreover, the present invention provides for the stable and accurate registration of printed images. Hence, the invention is suitable for printing highly complex designs requiring multiple images.

Through out the description and claims of this specification, the words "comprise" and "contain" and variations of the words, for example "comprising" and "comprise", means including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

What is claimed is:

1. A rotary printing station for printing an image on a web comprising (a) a rotatable cylindrical screen comprising at least one printing zone and at least one non-printing zone;

(b) an ink supply means for supplying ink to an inner surface of the screen and a squeegee for transferring ink through the printing zone of the screen onto the web;

(c) web line means for driving a web past the screen at a web line speed;

(d) control means for rotatably driving the screen:

(i) under a first motion profile as the printing zone passes over the web, so as to print an image directly from the rotatable cylindrical screen onto the web; and (ii) under a second, different motion profile as the non-printing zone passes over the web so as to form a non-printed region on the web that is longer than the circumferential length of the non-printing zone.

2. A station according to claim 1, wherein the control means are configured to rotatably drive the screen during the first motion profile at a predetermined printing speed.

3. A station according to claim 2, wherein the predetermined printing speed is at least substantially synchronised with the web line speed.

4. A station according to claim 2, wherein the predetermined printing speed is a speed suitable for providing a slipping printing effect.

5. A station according to claim 1, wherein the control means are configured to rotatably drive the screen under the second motion profile; such that (i) the rotation of the screen is suspended or the speed of rotation is reduced from the predetermined printing speed when the non-printing zone is in registration with the web; and (ii) the rotation of the screen is increased such that the screen is rotating at the predetermined printing speed as the subsequent printing zone is coming into the registration with the web.

6. A station according to claim 5, wherein the control means are further configured to reversibly drive the screen prior to increasing the speed of rotation to the predetermined printing speed.

7. A station according to claim 1, further comprising adjusting means to lift the squeegee away from the screen as the non-printing zone passes over the web and to reapply the squeegee to the screen as the printing zone comes into registration with the web.

8. A station according to claim 1, further comprising adjusting means to lift the screen away from the web as the non-printing zone passes over the web and reapply the screen to the web as the printing zone comes into registration with the web.

9. A station according to claim 1, further comprising a key mark registration system to detect the position of the web with respect to the rotational position of the screen.

10. A station according to claim 9, wherein the key mark registration system comprises means to mark the web with respect to every desired printing region and, if required, initiate phase adjustment of screen so as bring a predetermined printing zone of the screen into registration with a desired printing region.

11. A station according to claim 1, further comprising containment means to at least substantially contain ink in a predetermined region on the inner surface of the screen.

12. A rotary printing system for printing a design having a plurality of images; the system comprising:

(a) a plurality of rotary printing stations, whereby at least one of the stations is a rotary printing station as defined in claim 1 and;

(b) web line means to feed web between the rotary printing stations.

13. A method printing a design on a web having a plurality of images:

(a) using a plurality of rotary printing stations, whereby at least one of the stations is a rotary printing station as defined in claim 1 and;

(b) using web line means to feed web between the rotary printing stations.

14. A method of printing a web with an image:

using a rotatable cylindrical screen, provided with an internal ink supply and an internal squeegee and having a screen surface with at least one printing zone and at least one non-printing zone;

feeding a web past the screen at a web line speed;

rotating the screen under a first motion profile as the printing zone passes over the web, so as to print an image directly from the rotatable cylindrical screen onto the web; and rotating the screen under a second, different motion profile as the non-printing zone passes over the web so as to form a non-printed region on the web that is longer than the circumferential length of the non-printing zone.

15. A method according to claim 14 wherein:

rotating of the screen under the first motion profile comprises rotating the screen at a predetermined printing speed when a permeable stencil area is in registration with the web.

16. A method according to claim 15 wherein:

rotating the screen at a predetermined printing speed comprises rotating the screen at a speed synchronised with the web line speed of the web.

17. A method according to claim 14 wherein:

rotating the screen under a second motion profile comprises suspending the rotation of the screen or reducing the rotational speed of the screen from the printing speed when a non-printing zone is in registration with the web; and increasing the rotation of the screen to the predetermined printing speed as a permeable area comes into registration with the web.

18. A method according to claim 17, wherein:

rotating the screen under to second motion profile further comprises reversibly rotating the screen prior to increasing the rotation of the speed to the predetermined printing speed.

19. A method according to claim 14 further comprising:

lifting the squeegee away from the screen surface as the non-printing zone passes over the web and then reapplying the squeegee to the screen surface as the printing zone comes into registration with the web.

20. A method according to claim 14 further comprising lifting the screen away from the web when the non-printing zone passes over the web and then re-positioning the screen in mating contact with the web as the printing zone comes into registration with the web.

21. A method according to claim 14 further comprising:

using a key mark registration system to print a mark on the web with respect to every desired printed region and, if required adjust the phase of the screen so as to bring the desired printed region into registration with a predetermined printing zone.

22. A method according to claim 14, further comprising:

using a containment chamber to at least substantially contain ink within a restricted region on the screen surface.

* * * * *